US006837296B2

(12) United States Patent
Kimener

(10) Patent No.: US 6,837,296 B2
(45) Date of Patent: Jan. 4, 2005

(54) SAFETY BARRIER ASSEMBLY

(75) Inventor: Tom Kimener, Loveland, OH (US)

(73) Assignee: Midwest Industrial Door, Inc., Loveland, OH (US)

( * ) Notice: Subject to any disclaimer, the term of this patent is extended or adjusted under 35 U.S.C. 154(b) by 0 days.

(21) Appl. No.: 10/298,173

(22) Filed: Nov. 15, 2002

(65) Prior Publication Data

US 2004/0093798 A1 May 20, 2004

(51) Int. Cl.[7] ..... E05D 15/06

(52) U.S. Cl. ..... 160/201; 160/113; 160/114; 49/385

(58) Field of Search ..... 160/201, 113, 160/114, 191, 229.1, 352, 112; 49/97, 385

(56) References Cited

U.S. PATENT DOCUMENTS

| | | | | | |
|---|---|---|---|---|---|
| 4,009,767 | A | * | 3/1977 | Stadigh | 187/280 |
| 4,041,646 | A | | 8/1977 | Mittag | |
| 4,094,541 | A | * | 6/1978 | Simms | 292/231 |
| 4,150,510 | A | | 4/1979 | Harrison et al. | |
| 4,235,169 | A | * | 11/1980 | Peterson | 105/251 |
| 4,248,461 | A | * | 2/1981 | Stevens | 292/218 |
| 4,290,660 | A | * | 9/1981 | Brezosky | 312/249.8 |
| 4,352,460 | A | * | 10/1982 | Purtell | 239/1 |
| 4,422,264 | A | | 12/1983 | Harris | |
| 4,520,898 | A | * | 6/1985 | Allemane | 182/113 |
| 4,538,379 | A | | 9/1985 | Vargo | |
| 4,573,333 | A | * | 3/1986 | Choi | 70/279.1 |
| 5,184,572 | A | * | 2/1993 | Meier | 119/733 |
| 5,419,010 | A | | 5/1995 | Mullet | |
| 5,440,838 | A | * | 8/1995 | Lesser | 49/340 |
| 5,511,257 | A | * | 4/1996 | Hannes | 5/100 |
| 5,546,703 | A | | 8/1996 | Conway | |
| 5,549,149 | A | * | 8/1996 | Sills et al. | 160/201 |
| 5,566,740 | A | | 10/1996 | Mullet et al. | |
| 5,572,829 | A | | 11/1996 | Stoltenberg | |
| 5,577,544 | A | | 11/1996 | Carper et al. | |
| 5,592,779 | A | | 1/1997 | Conway | |
| 5,626,176 | A | | 5/1997 | Lewis, Jr. et al. | |
| 5,671,500 | A | | 9/1997 | Balk | |
| 5,698,073 | A | | 12/1997 | Vincenzi | |

(List continued on next page.)

OTHER PUBLICATIONS

Catalog for Roly Safeti–Gate, 1997–98, Mezzanine Safeti–Gates, Inc., Essex, MA.
Brochure for Roly Safeti–Gate Power Model, Mezzanine Safeti–Gates, Inc., Essex, MA.
Brochure for Roly Safeti–Gate Pivot Model, Mezzanine Safeti–Gates, Inc., Essex, MA.
Brochure for Roly Safeti–Gate Tri–Side Model, Mezzanine Safeti–Gates, Inc., Essex, MA.
Brochure for Roly Safeti–Gate Rack Supported Model, Mezzanine Safeti–Gates, Inc., Essex, MA.
Brochure for Roly Safeti–Gate 90–Degree Model, Mezzanine Safeti–Gates, Inc., Essex, MA.
www.vestilmfg.com/products, webpages 1–4, copyright 2001, Vestil Manufacturing Company, Angola, IN.

*Primary Examiner*—Bruce A. Lev
(74) *Attorney, Agent, or Firm*—Taft, Stettinius & Hollister LLP

(57) ABSTRACT

A barrier assembly for protecting an edge of a loading platform includes: a gate reciprocating between a barrier position approximate an edge of a loading platform and an open position away from the edge of the loading platform, and a toe barrier mounted approximate the edge of the loading platform and operatively coupled to the primary gate to reciprocate between a barrier position and an open position. The toe barrier provides a vertical barrier along a floor of the loading platform approximate the edge of the loading platform in its barrier position, and is operative to reciprocate to its barrier position when the primary gate is in its barrier position and to reciprocate to its open position when the primary gate is in its open position.

36 Claims, 22 Drawing Sheets

U.S. PATENT DOCUMENTS 5,701,701 A 12/1997 Desrosiers
5,709,050 A 1/1998 Benko
5,749,407 A 5/1998 Brenner et al.
5,782,283 A 7/1998 Kendall
5,896,944 A * 4/1999 McMillian et al. ..... 182/45
6,070,700 A * 6/2000 Nagel ..... 187/335
6,138,812 A 10/2000 Kimener
6,212,826 B1 4/2001 Kimener

* cited by examiner

SAFETY BARRIER ASSEMBLY

BACKGROUND

1. Field of the Invention

The present invention is directed to aspects of a barrier assembly protecting the edge of an elevated loading platform or mezzanine, where the loading platform is adapted to receive pallets of articles from an elevated load-in side of the loading platform, and where workers/handlers will remove the articles from a handling side of the loading platform. In particular, the barrier assembly provides a protective barrier on the load-in side of the loading platform when workers are removing articles from the handling side of the platform and also provides a barrier on the handling side of the loading platform when the articles are being loaded onto the platform by forklift trucks through the load-in side of the platform.

2. Description of the Related Art

A typical distribution center or warehouse may include a plurality of elevated loading platforms or mezzanines that have openings on the load-in side of the loading platforms for receiving pallets of articles from forklift trucks, and that also have openings on the handling side of the loading platforms for facilitating removal of the loaded articles by workers. Even though the workers will typically remain clear from the load-in side of the loading platform while removing the articles therefrom, the openings from the load-in side of the loading platforms for receiving the pallets from the forklift trucks present a potential fall hazard for the workers. Furthermore, even though workers will typically remain clear from the loading platform while pallets are being loaded onto the platform by forklift trucks, openings into the loading platform during this operation present a potential fall hazard for the workers as well as a potential for injuries caused by the loading articles.

U.S. Pat. No. 4,422,264 discloses a safety gate assembly that includes first and second safety gates, each of which have rollers that are received within a pair of parallel, inverted U-shaped tracks. The safety gates are coupled together by cables, which are guided between the gates by pulleys positioned above the gates. When one of the safety gates is lifted (providing access to one side of the preselected area) the pulley assembly will operate so as to allow the second safety gate to be lowered into a position blocking entrance to the opposite side of the preselected area. Likewise, when the second safety gate is lifted so as to allow entrance to the preselected area, the cable and pulley assembly will operate so as to allow the first safety gate to be lowered again, thereby restricting entrance to the preselected area from its opposite position.

U.S. Pat. No. 6,212,826, owned by the assignee of the present invention, discloses a safety assembly that includes a pair of parallel guide rails, each shaped generally as an inverted U; a first gate segment having at least one pair of rollers positioned on opposite lateral sides thereof, where each roller is received within a respective one of the guide rails so that the first gate segment is guided by the pair of guide rails; a second gate segment having at least one pair of rollers positioned on opposite lateral sides thereof, where each roller is received within a respective one of the guide rails so that the second gate segment is guided by the pair of guide rails; and at least one substantially rigid cross-bar pivotally connected between the first and second gate segments. The first gate segment is guided by the guide rails from a first barrier position in which it is positioned entirely within the front vertical portions of the guide rails to an open position in which it is positioned at least partially in the horizontal portion of the guide rails; and the second gate segment is guided by the guide rails from a second barrier position in which it is positioned entirely within the back vertical portions of the guide rails to an open position in which it is positioned at least partially in the horizontal portion of the guide rails. The cross-bar has a length which requires that when the first gate segment is in its barrier position the second gate segment will be in its open position, and vice-versa. Therefore, because the cross-bar is substantially rigid, it will restrict the first and second gate segments from being lifted simultaneously to their open positions.

SUMMARY OF THE INVENTION

Exemplary embodiments of the present invention include a barrier assembly that provides a barrier on a handling side of an elevated loading platform when articles are being loaded onto the platform, through a load-in side of the platform, and provides two barriers on the load-in side of the elevated platform when articles are being removed from the loading platform through the handling side of the platform by workers. The two load-in side barriers include a standard personnel barrier and an additional toe plate barrier. Exemplary embodiments also include a barrier assembly that allows the position of the barriers to be locked while in their respective barrier position, thereafter to be unlocked and reciprocated. Exemplary embodiments also included a barrier assembly with motorized operation.

It is a first aspect of the present invention to provide a barrier assembly for protecting an edge of a loading platform that includes: a gate reciprocating between a barrier position approximate an edge of a loading platform and an open position away from the edge of the loading platform; and, a toe barrier mounted approximate the edge of the loading platform and operatively coupled to the primary gate to reciprocate between a barrier position, which provides a vertical barrier along a floor of the loading platform approximate the edge of the loading platform, and an open position, which substantially removes the vertical barrier, where the toe barrier is operatively coupled with the gate to reciprocate to its barrier position when the gate is in its barrier position and to reciprocate to its open position when the gate is in its open position.

It is a second aspect of the present invention to provide a barrier assembly for protecting a loading platform, where the loading platform has a loading edge and a personnel entrance distal from and substantially parallel to the loading edge, and where the barrier assembly includes: a pair of parallel guide rails, each having a first substantially vertical portion, a second substantially vertical portion opposite the first substantially vertical portion and elevated substantially horizontal portions operatively between the first and second substantially vertical portions; a first gate segment having at least one pair of rollers positioned on opposite lateral sides thereof, where each roller is received by a respective one of the guide rails so that the first gate segment is guided by the pair of guide rails from an upper first-side barrier position in which the first gate segment is positioned within the first substantially vertical portions of the pair of guide rails to a first-side open position in which the first gate segment is positioned at least partially within the substantially horizontal portions of the pair of guide rails; and, a toe barrier spanning at least a portion of the distance between lower ends of the first substantially vertical portions of the guide rails, operative to arrive at a lower first-side barrier position, below the upper first-side barrier position, while the first gate segment is approximate its upper first-side barrier position, and operative to return to an open position while the first gate segment is approximate its first-side open position.

It is a third aspect of the present invention to provide a barrier assembly for protecting an edge of a loading platform that includes: a barrier reciprocating along at least one rail between a barrier position approximate an edge of a loading platform and an open barrier position away from the edge of the loading platform; and an automatic lock operative to maintain the barrier in its barrier position.

It is a fourth aspect of the present invention to provide a barrier assembly for protecting a loading platform, where the loading platform has a loading edge and a personnel entrance distal from and substantially parallel to the loading edge, and where the barrier assembly includes: a pair of parallel guide rails, each having a first substantially vertical portion, a second substantially vertical portion opposite the first substantially vertical portion and elevated substantially horizontal portions extending from the first and second substantially vertical portions; a first gate segment having at least one pair of rollers positioned on opposite lateral sides thereof, each roller being received by a respective one of the guide rails so that the first gate segment is guided by the pair of guide rails from a barrier position in which the first gate segment is positioned within the first substantially vertical portions of the pair of guide rails to an open position in which the first gate segment is positioned at least partially within the substantially horizontal portions of the pair of guide rails; a second gate segment having at least one pair of rollers positioned on opposite lateral sides thereof, each roller being received by a respective one of the guide rails so that the second gate segment is guided by the pair of guide rails from a barrier position in which the second gate segment is positioned within the second substantially vertical portions of the pair of guide rails to an open position where the second gate segment is positioned at least partially within the substantially horizontal portions of the pair of guide rails; a connector operatively coupling the first gate segment and the second gate segment, such that the first gate segment is in the open position when the second gate segment is in the barrier position, and vice versa; and, an automatic lock operative to lock the first gate segment in its barrier position and to lock the second gate segment in its open position upon the first and second gate segments arriving in said respective barrier and open positions.

It is a fifth aspect of the present invention to provide a barrier assembly for protecting a loading platform, where the loading platform has a loading edge and a personnel entrance distal from and substantially parallel to the loading edge, and where the barrier assembly includes: a pair of parallel guide rails, each having a first substantially vertical portion, a second substantially vertical portion opposite the first substantially vertical portion and elevated substantially horizontal portions extending from the first and second substantially vertical portions; a first gate segment having at least one pair of rollers positioned on opposite lateral sides thereof, where each roller is received by a respective one of the guide rails so that the first gate segment is guided by the pair of guide rails from a barrier position in which the first gate segment is positioned within the first substantially vertical portions of the pair of guide rails to an open position in which the first gate segment is positioned at least partially within the substantially horizontal portions of the pair of guide rails; a second gate segment having at least one pair of rollers positioned on opposite lateral sides thereof, where each roller is received by a respective one of the guide rails so that the second gate segment is guided by the pair of guide rails from a barrier position in which the second gate segment is positioned within the second substantially vertical portions of the pair of guide rails to an open position where the second gate segment is positioned at least partially within the substantially horizontal portions of the pair of guide rails; a coupling assembly operatively coupling the first gate segment and the second gate segment, such that the first gate segment is in the open position when the second gate segment is in the barrier position, and vice versa; and, a motorized drive system operatively coupled to the first gate segment, the second gate segment and/or the coupling assembly to provide automated reciprocation between the barrier and open positions of the first and second gate segments.

It is a sixth aspect of the present invention to provide a method for protecting an edge of an elevated mezzanine, having an elevated loading-side edge and a pick-side, where the method includes the steps of: providing a pick-side barrier that reciprocates between an open position and a barrier position in a pick-side opening, and a loading-side barrier that reciprocates between an open position and a barrier position in a loading-side opening, where the two barriers are operatively coupled such that when the pick-side barrier is in its open position the loading-side barrier is in its barrier position, and when the pick-side barrier is in its barrier position, the loading-side barrier is in its open position; traveling the loading-side barrier to its barrier position and the pick-side barrier to its open position; and, substantially simultaneous to the traveling step, automatically erecting a toe barrier along the floor approximate the loading-side edge.

It is a seventh aspect of the present invention to provide a method for protecting an edge of an elevated mezzanine, having an elevated loading-side edge and a pick-side, where the method includes the steps of: providing a pick-side barrier along at least one rail reciprocating between an open position and a barrier position in a pick-side opening, and a loading-side barrier reciprocating between an open position and a barrier position in a loading-side opening, the two barriers being operatively coupled such that when the pick-side barrier is in its open position the loading-side barrier is in its barrier position, and when the pick-side barrier is in its barrier position, the loading-side barrier is in its open position; traveling the loading-side barrier to its closed position and the pick-side barrier to its open position; and, locking the loading-side barrier in its closed position and the pick-side barrier in its open position during or after the traveling step.

It is an eighth aspect of the present invention to provide a barrier assembly for protecting an edge of a loading platform comprising: a gate reciprocating between a barrier position approximate an edge of a loading platform and an open position away from the edge of the loading platform; a toe barrier mounted approximate the edge of the loading platform and operatively coupled to the primary gate to reciprocate between a barrier position, which provides a vertical barrier along a floor of the loading platform approximate the edge of the loading platform, and an open position, which substantially removes the vertical barrier; and, a means for operatively coupling the toe barrier with the gate to reciprocate the toe barrier to its barrier position when the gate is in its barrier position and to reciprocate the toe barrier to its open position when the gate is in its open position.

It is a ninth aspect of the present invention to provide a barrier assembly for protecting a loading platform, the loading platform having a loading edge and a personnel entrance distal from and substantially parallel to the loading edge, the barrier assembly comprising: a pair of parallel guide rails, each having a first substantially vertical portion, a second substantially vertical portion opposite the first substantially vertical portion and an elevated substantially horizontal portion operatively interconnecting the first and second substantially vertical portions; a first gate segment having at least one pair of rollers positioned on opposite lateral sides thereof, each roller being received by a respective one of the guide rails so that the first gate segment is guided by the pair of guide rails, the first gate segment being guided by the pair of guide rails from an upper first-side barrier position in which the first gate segment is positioned within the first substantially vertical portions of the pair of guide rails to a first-side open position in which the first gate segment is positioned at least partially within the substantially horizontal portions of the pair of guide rails; and, a toe barrier spanning at least a portion of the distance between lower ends of the first substantially vertical portions of the guiding means; and, a means for positioning the toe barrier at a lower first-side barrier position, below the upper first-side barrier position, while the first gate segment is approximate its upper first-side barrier position, and to return to the toe barrier to an open position while the first gate segment is approximate its first-side open position.

It is a tenth aspect of the present invention to provide a method A barrier assembly for protecting an edge of a loading platform comprising: a barrier reciprocating along at least one rail between a barrier position approximate an edge of a loading platform and an open barrier position away from the edge of the loading platform; and, a means for locking the barrier in at least one of its barrier position and its open position.

It is an eleventh aspect of the present invention to provide a barrier assembly for protecting a loading platform, the loading platform having a loading edge and a personnel entrance distal from and substantially parallel to the loading edge, the barrier assembly comprising: a pair of parallel guide rails, each having a first substantially vertical portion, a second substantially vertical portion opposite the first substantially vertical portion and elevated substantially horizontal portions extending from the first and second substantially vertical portions; a first gate segment having at least one pair of rollers positioned on opposite lateral sides thereof, each roller being received by a respective one of the guide rails so that the first gate segment is guided by the pair of guide rails, the first gate segment being guided by the pair of guide rails from a barrier position in which the first gate segment is positioned within the first substantially vertical portions of the pair of guide rails to an open position in which the first gate segment is positioned at least partially within the substantially horizontal portions of the pair of guide rails; a second gate segment having at least one pair of rollers positioned on opposite lateral sides thereof, each roller being received by a respective one of the guide rails so that the second gate segment is guided by the pair of guide rails, the second gate segment being guided by the pair of guide rails from a barrier position in which the second gate segment is positioned within the second substantially vertical portions of the pair of guide rails to an open position where the second gate segment is positioned at least partially within the substantially horizontal portions of the pair of guide rails; a means for operatively coupling the first gate segment and the second gate segment, wherein the first gate segment is in the open position when the second gate segment is in the barrier position, and vice versa; and, a means for operatively locking the first gate segment in its barrier position and to lock the second gate segment in its open position upon the first and second gate segments arriving in their respective barrier and open positions.

It is a twelfth aspect of the present invention to provide a barrier assembly for protecting a loading platform, the loading platform having a loading edge and a personnel entrance distal from and substantially parallel to the loading edge, the barrier assembly comprising: a pair of parallel guide rails, each having a first substantially vertical portion, a second substantially vertical portion opposite the first substantially vertical portion and elevated substantially horizontal portions extending from the first and second substantially vertical portions; a first gate segment having at least one pair of rollers positioned on opposite lateral sides thereof, each roller being received by a respective one of the guide rails so that the first gate segment is guided by the pair of guide rails, the first gate segment being guided by the pair of guide rails from a barrier position in which the first gate segment is positioned within the first substantially vertical portions of the pair of guide rails to an open position in which the first gate segment is positioned at least partially within the substantially horizontal portions of the pair of guide rails; a second gate segment having at least one pair of rollers positioned on opposite lateral sides thereof, each roller being received by a respective one of the guide rails so that the second gate segment is guided by the pair of guide rails, the second gate segment being guided by the pair of guide rails from a barrier position in which the second gate segment is positioned within the second substantially vertical portions of the pair of guide rails to an open position where the second gate segment is positioned at least partially within the substantially horizontal portions of the pair of guide rails; a means for operatively coupling the first gate segment and the second gate segment, wherein the first gate segment is in the open position when the second gate segment is in the barrier position, and vice versa; and, a motorized means for reciprocating least one of the first gate segment, the second gate segment and the coupling assembly to provide automated reciprocation between the barrier and open positions of the first and second gate segments.

It is a thirteenth aspect of the present invention to provide a barrier assembly for protecting a loading platform, the loading platform having a loading edge and a personnel entrance distal from and substantially parallel to the loading edge, the barrier assembly comprising: a means for guiding gate segments having a first substantially vertical portion, a second substantially vertical portion opposite the first substantially vertical portion and an elevated substantially horizontal portion operatively between the first and second substantially vertical portions; a first gate segment having means for mounting the guide means to the first gate segment so that the first gate segment is guided by the guide means from an upper first-side barrier position in which the first gate segment is positioned within the first substantially vertical portions of the guide means to a first-side open position in which the first gate segment is positioned at least partially within the substantially horizontal portions of the guide means; a toe barrier spanning at least a portion of the distance between lower ends of the first substantially vertical portions of the guiding means; and, a means for positioning the toe barrier at a lower first-side barrier position, below the upper first-side barrier position, while the first gate segment is approximate its upper first-side barrier position, and to return to the toe barrier to an open position while the first gate segment is approximate its first-side open position.

Other aspects and advantages of the disclosed inventions will be apparent from the following description, the appended claims and the attached drawings.

DETAILED DESCRIPTION OF THE PREFERRED EMBODIMENTS

It is to be understood that the following detailed description of exemplary embodiments of the invention are exemplary in nature and shall not constitute limitations upon the invention. Although certain aspects of the exemplary embodiments are shown in more detail, some features of the embodiments that may not be directly relevant to the invention may have been omitted for the sake of clarity and brevity.

Figure 1:
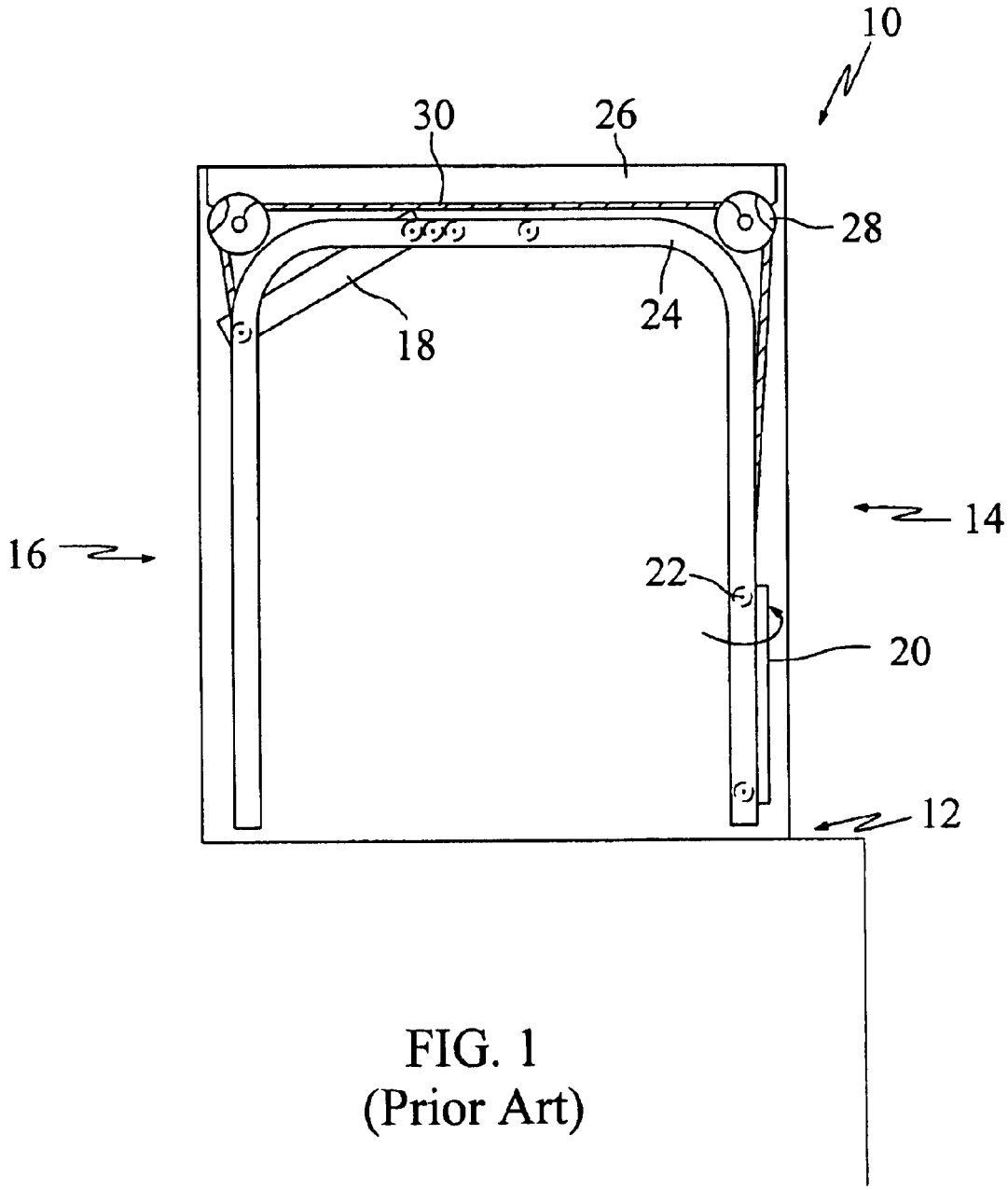
FIG. 1 (Prior Art)
FIG. 1 is a side elevational view of a prior art barrier assembly.

Referring to FIG. 1, a profile view of a prior art safety gate assembly 10 disposed on an elevated platform or mezzanine 12 guards a load-in area 14 of the elevated platform to provide controlled access thereto from the mezzanine 12 as well as from the handling side 16. When a safety gate 18 on the handling side is open, a safety gate 20 on the loading side is automatically closed and vice versa. The assembly 10 includes a plurality of rollers 22 each mounted at the end of a stem and attached one of the gates. The rollers 22 engage, and are thus guided by a pair of inverted U-shaped tracks 24. The tracks 24 are fastened to, and supported by, support members 26 which also support pulleys 28 having a cable 30 run therethrough and affixed to the gates 18, 20. The cables 30 and pulleys 28 operatively couple the two gates together such that the handling side safety gate 18 will be open when the loading side gate 20 is in a barrier position (as shown in FIG. 1); and such that the loading side safety gate 20 will be open when the handling side gate 18 is in its barrier position, blocking personnel from falling off the mezzanine 12.

Figure 2:
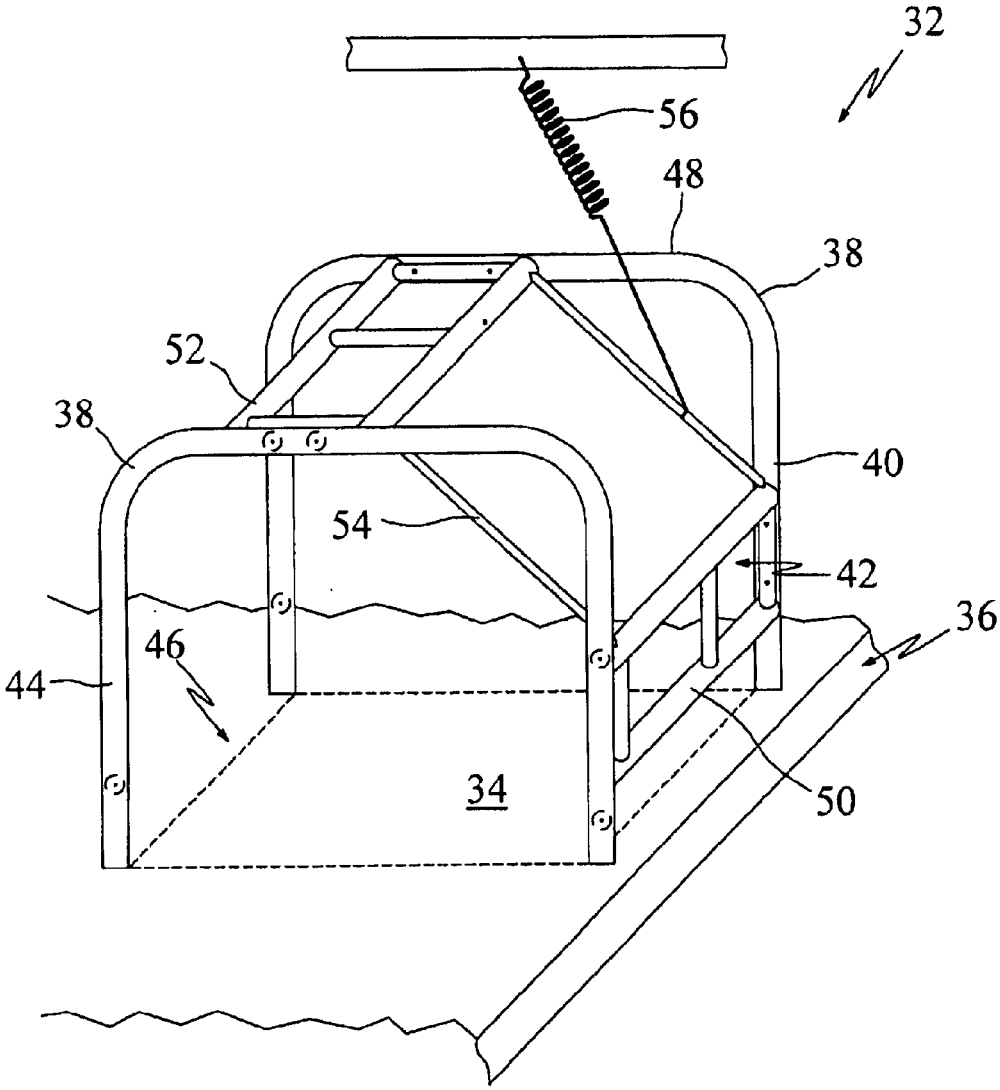
FIG. 2 (Prior Art)
FIG. 2 is an elevated perspective view of another prior art barrier assembly.

As shown in FIG. 2, a second prior art reciprocating barrier assembly 32 is positioned upon a loading area 34 of an elevated loading platform or mezzanine 36. The second prior art barrier assembly is described in detail in U.S. Pat. No. 6,212,826, which is hereby incorporated by reference. The reciprocating barrier assembly 32 includes a pair of parallel guide rails 38 that are shaped generally as an inverted-U and have a first substantially vertical portion 40 approximate a load-in side 42 of the elevated loading platform or mezzanine 36, a second substantially vertical portion 44 approximate a handling entrance side 46 of the elevated loading platform or mezzanine 36 and a substantially horizontal portion 48 interconnecting the first and second substantially vertical portions 40, 44. A loading barrier 50 is shown in its barrier position and connected to a handling barrier 52 in its open position by a cross-bar 54; or, alternatively, a segmented cross-bar. The cross-bar 54 may be coupled to a spring 56 to reduce the amount of effort necessary by a user to reciprocate the barriers 50, 52. In this prior art barrier, the cross-bar 54 operatively couples the two gates together such that the handling side gate 52 is in its open position when the loading side gate 50 is in its barrier position (as shown in FIG. 2), and vice versa.

Figure 3:
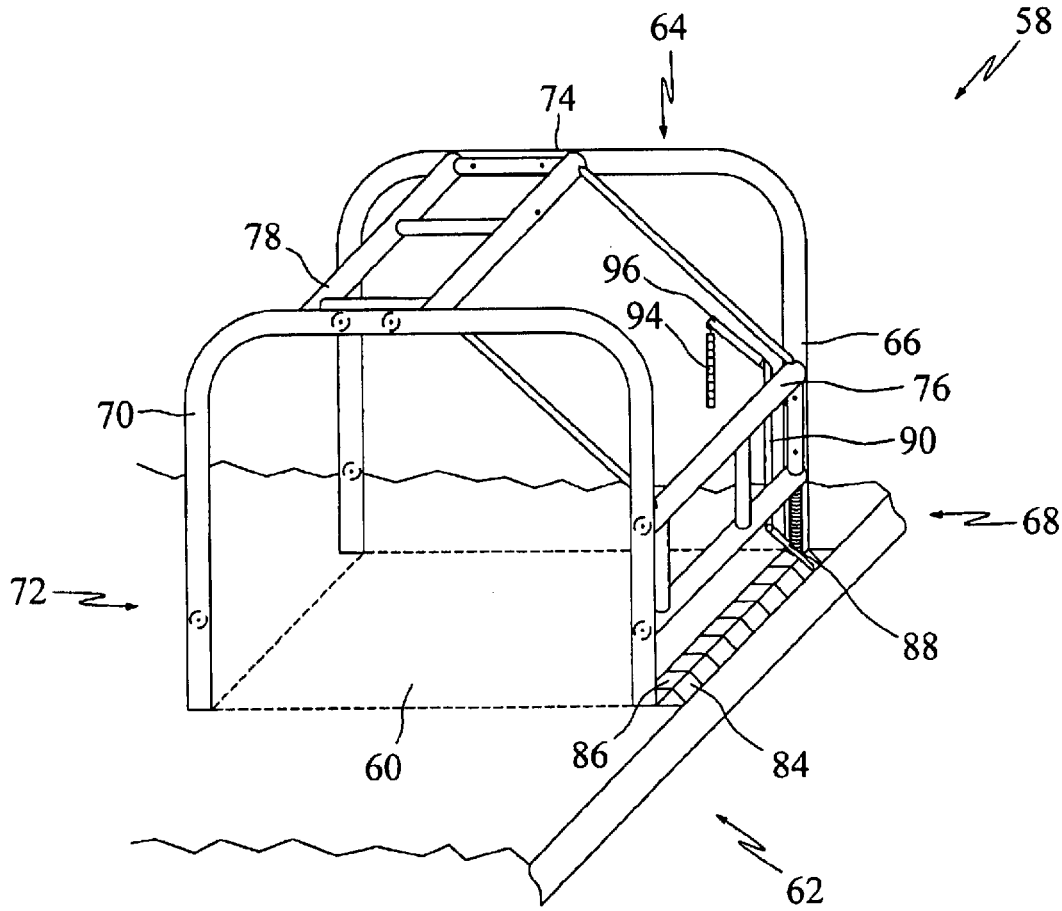
FIG. 3 is an elevated perspective view of a barrier assembly incorporating an exemplary toe barrier and mechanism.

Referring to FIG. 3, a first exemplary embodiment of a barrier assembly 58 of the present invention is positioned upon a loading area 60 approximate an edge of an elevated loading platform or mezzanine 62. The barrier assembly 58 includes a pair of parallel guide rails 64 that are shaped generally as an inverted-U and have a first substantially vertical portion 66 approximate a load-in side 68 of the elevated loading platform or mezzanine 62, a second substantially vertical portion 70 approximate a handling side 72 of the elevated loading platform or mezzanine 62 and a substantially horizontal portion 74 interconnecting the first and second substantially vertical portions 66, 70. A load-in side gate 76 is shown in FIG. 3 in its barrier position and is connected to a handling side gate 78, shown in its open position, via a cross-bar 80. Along the floor of the loading area, between the load-in side vertical portions 66 of the rails, and below the load-in side gate 76, spans a toe barrier mechanism 82. The toe barrier mechanism 82, in this exemplary embodiment, includes a toe plate 84 pivotally coupled to the base plate 86, both of which span horizontally along the floor of the platform 62 between the first substantially vertical portions 66 of the guide rails 64. As will be discussed in detail below, the toe barrier plate 84 is operative to lie flat on the floor (in an "open" position) when the load-in side gate 76 is in its open position and is also to flip up perpendicular to the floor (to a "barrier" position) when the load-in side gate 76 is in its barrier position.

Figure 4:
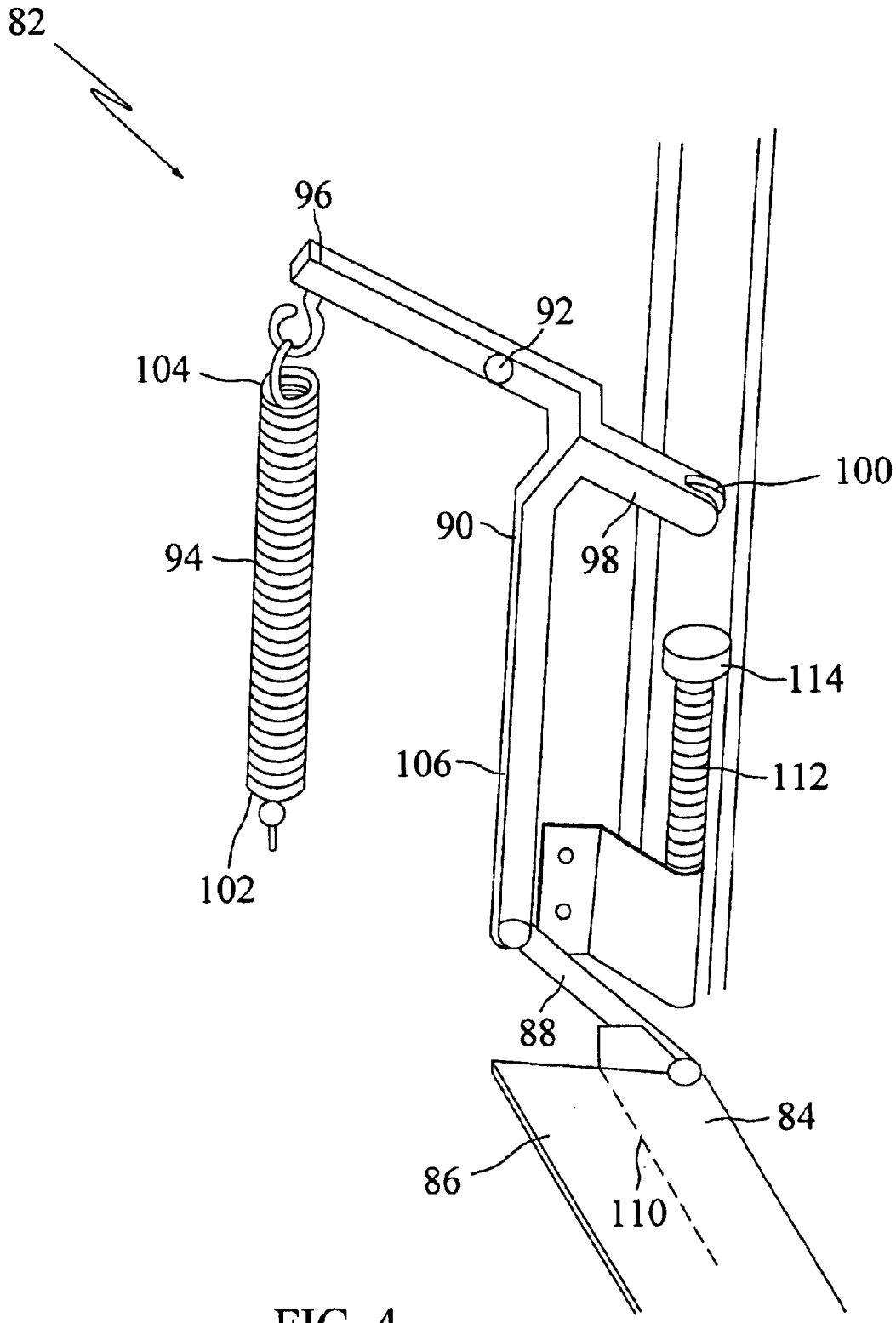
FIG. 4 is a magnified, partial perspective view of an exemplary toe barrier and mechanism in its non-barrier position in accordance with an aspect of the present invention.
Figure 5:
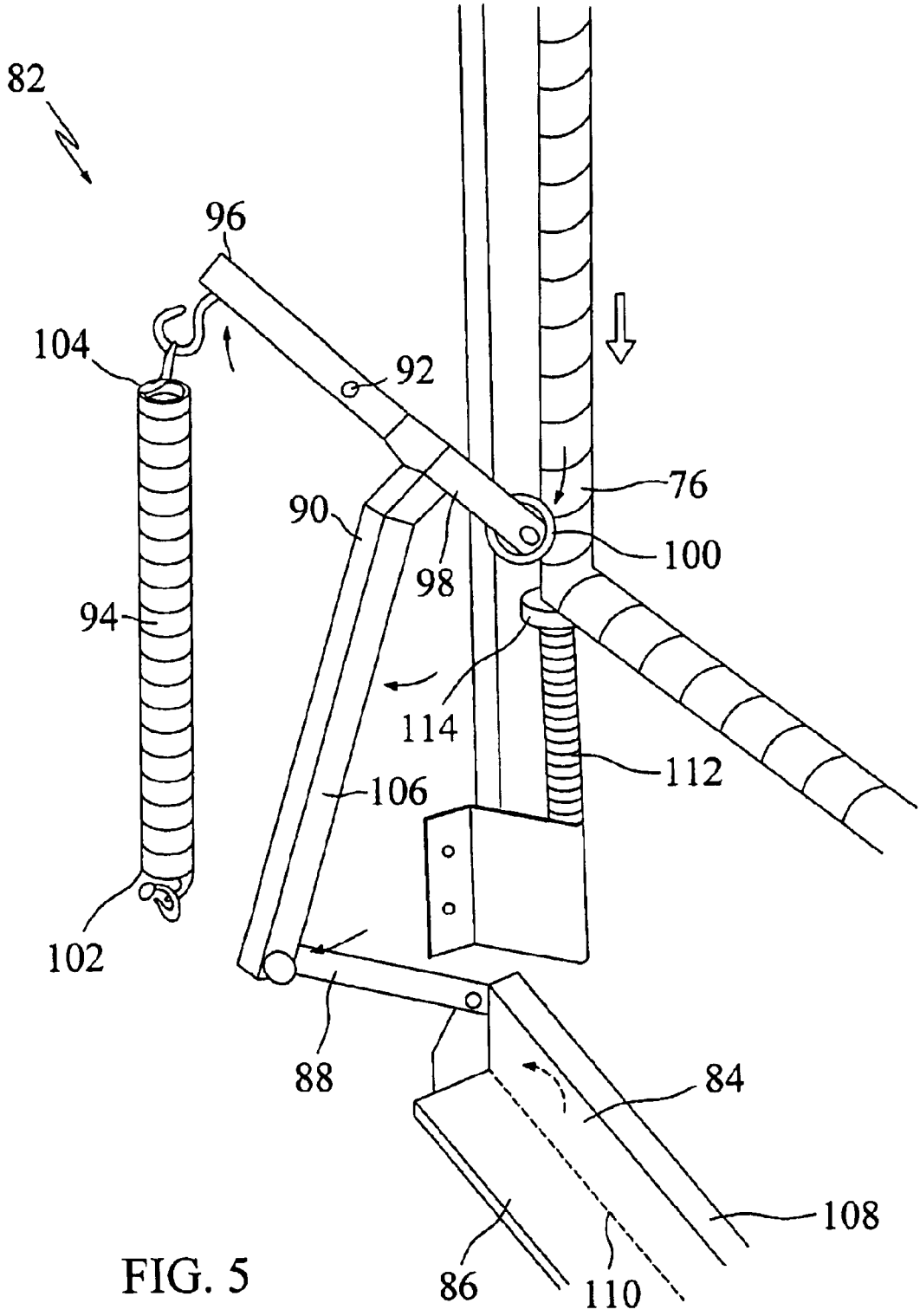
FIG. 5 is a magnified, partial perspective view of the exemplary toe barrier and mechanism in its barrier position in accordance with an aspect of the present invention.

As shown in FIGS. 4 and 5, the toe barrier plate 84 is pivotally coupled to an actuator bar 88, which is in turn pivotally coupled to a lever 90. The lever 90 is pivotally secured a support structure (not shown) at pivot point 92. A spring 94 coupled to a first arm 96 of the lever 90 biases the first arm 96 downwardly such that an opposing, second arm 98 of the lever is biased upwardly to place a roller 100 connected on the end of the second arm 98 into the travel path of the load-in side gate 76.

Referring specifically to FIG. 4, the spring 94 is mounted to the support structure (not shown) at its distal end 102 and to the first arm 96 of the lever 90 at its proximal end 104. The location of the pivot point 92 and the tension of the spring 94 cause the second arm 98 to be biased upwardly to place the roller 100 into the path of the load-in side gate 76. The lever 90 also includes a third arm 106 extending from the second arm 98 so as to pivot with the second arm 98. The third arm 106 is angled with respect to the second arm 98 to travel rearwardly as the second arm 98 travels downwardly and inwardly, and to travel forwardly as the second arm 98 travels upwardly and outwardly. The third arm 106 is pivotally coupled to the actuator bar 88, which, in turn, is pivotally coupled to the toe plate 84. When the third arm 106 travels forwardly, it pushes the actuator bar 88, which in turn pushes on the end 108 of the toe plate 84, dropping or flipping the toe plate 84 down to its horizontal (open) orientation via hinge 110 as shown in FIG. 4. When the third arm 106 travels rearwardly, it pulls on the actuator bar 88, which in turn pulls on the end 108 of the toe plate 84, lifting or flipping the toe plate 84 back up to its perpendicular (barrier) position as shown in FIG. 5.

Following from the above description, it will be appreciated that the toe plate mechanism 82 operates with the barrier assembly substantially as follows: As shown in FIG. 4, while the load-in side gate 76 is in its open position, the second arm 98 is biased outwardly and upwardly, causing the third arm 106 to push the actuator bar 88 which pushes the toe barrier plate 84 to its horizontal and flat (open) position along the mezzanine 62 floor.

As shown in FIG. 5, as the load-in side gate 76 is moved downwardly into its barrier position it contacts the roller 100 mounted to the second arm 98 to push the second arm 98 inwardly and downwardly. The roller 100 rolls over the side-rail of the gate 76 as the gate passes the second arm 98. As the second arm is pushed inwardly and downwardly by the gate 76, the lever 90 pivots about its pivot point 92 and overcomes the bias of the spring 94 to pull the third arm 106 rearward so that the actuator bar 88 pulls the toe barrier plate 84 into its perpendicular barrier position. Accordingly, it will be appreciated that the toe plate mechanism 82 is operatively coupled with the load-in side gate 76 to flip the toe plate 84 to its barrier position when the gate 76 travels to its barrier position, and to drop the toe plate 84 back to its open position when the gate 76 travels back to its open position. While such operational coupling in this embodiment is mechanical, it is certainly within the scope of the invention that such operational coupling be an electromechanical device as can be contemplated by those of ordinary skill in the art. An example embodiment utilizing an electromechanical device is provided below.

The barrier position of the toe barrier may be perpendicular to the floor or may be at any angle sufficient to inhibit lateral movement along the floor and toward the edge of the loading platform 62. Further, the toe barrier plate 84 may be hinged with the base plate 86 or with the floor as an operative method of use and installation. As the load-in side gate 76 is reciprocated to its open position, the toe plate mechanism 82 returns to its position as shown in FIG. 4 with the toe barrier plate 84 being substantially horizontal and flat with the floor.

It has been found that the automatic toe barrier mechanism 82 described above is useful, for example, to block the wheels of manual lifts, used by workers to remove pallets deposited onto the loading platform 62 by fork-lifts, preventing the wheels from rolling below the loading side gate 76 and possibly off the edge of the loading platform 62.

As shown in FIGS. 4 & 5, below the roller 100 and in the line of travel of the load-in side gate 76 is a shock absorber 112 positioned within the guide rail for stopping the load-in side gate 76 at its barrier position. It is also desired, in this exemplary embodiment, that another set of shock absorbers 112 be positioned on the handling side as well, to stop the handling side gate 78 in its barrier position. The shock absorbers 112 are spring biased and include a cushion 114 on the proximal end to make initial contact with the gates 76, 78 and to assist in the repositioning of the gates from their barrier position to their open position.

Figure 6:
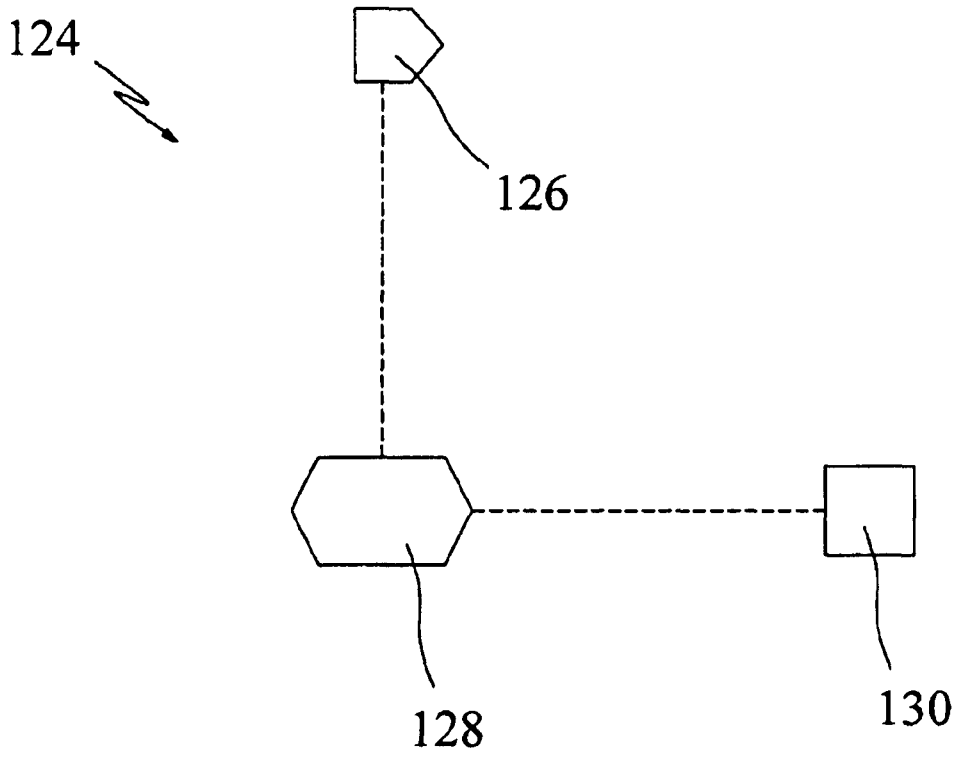
FIG. 6 is a schematic diagram of a first exemplary control system in accordance with an aspect of the present invention.
Figure 7:
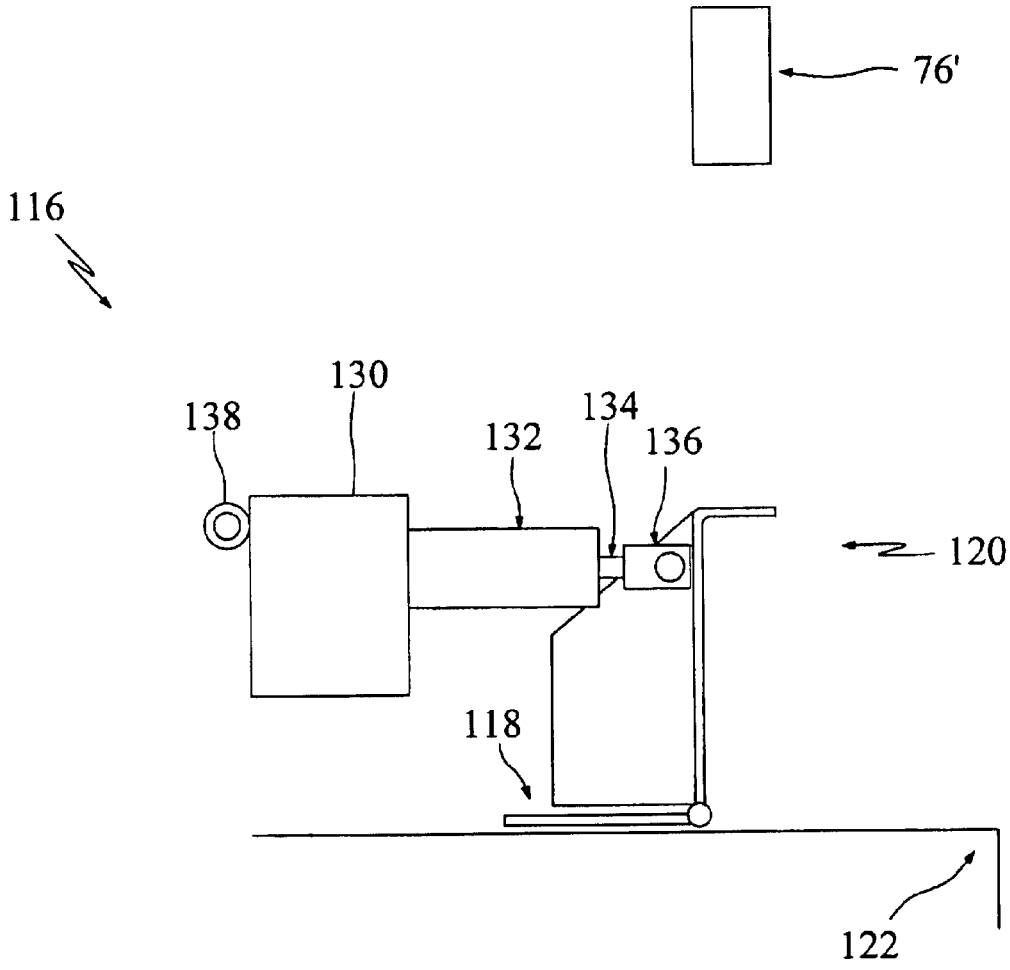
FIG. 7 is a profile view of a second exemplary toe barrier and mechanism in its barrier position in accordance with an aspect of the present invention.
Figure 8:
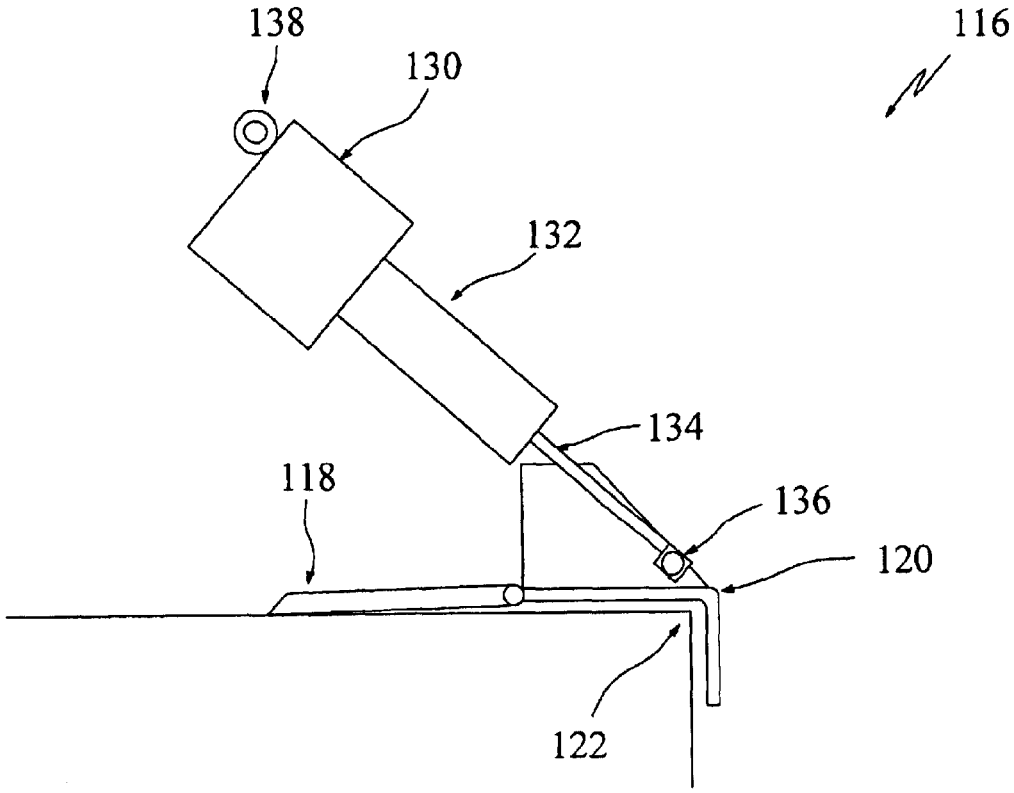
FIG. 8 is a profile view of the second exemplary toe barrier and mechanism in its open position in accordance with an aspect of the present invention.

Referencing FIGS. 6–8, a second exemplary embodiment of a toe barrier is shown as a power electromechanical toe barrier 116 having a base plate 118 and a pivoting toe board 120, positioned relative to a mezzanine 122. A control system 124 is operatively coupled to the power toe barrier 116 to regulate the position of the toe board 120 relative to the floor of the mezzanine 122. Referencing specifically FIG. 6, the control system 124 includes a sensor 126 that is operatively coupled to a control circuitry 128. The control circuitry 128 is also operatively coupled to a power actuator 130 for controlling the operation of a pneumatic cylinder 132 coupled thereto. The sensor 126 may provide feedback to the control circuitry indicating the position of the load-in side gate 76' relative to its barrier position, or may provide feedback to the control circuitry 128 in the sense of a true/false response to the query of whether the load-in side gate 76' is in its barrier position, or so closely approximates its barrier position to warrant positioning the toe board 120 to its barrier position. As the control circuitry 128 receives and/or sends signals to the sensor 126, the control circuitry 128 is configured to respond to variations in signal receipt so as to send the appropriate control signal to the power actuator 130 when repositioning of the toe board 120 is warranted relative to the position of the load-in side gate 76'.

As shown in FIGS. 7 and 8, the toe board 120 is pivotally coupled to a pneumatic piston 134 at a first pivot point 136, which is driven by the pneumatic cylinder 132, which is in turn coupled to the power actuator 130. The powered actuator 130 is pivotally secured a support structure (not shown) at a second pivot point 138. As the load-in side gate 76' is repositioned from its barrier position (See FIG. 7) to its open position (as shown in FIG. 8), the sensor 126 relays this change in position information to the control circuitry 128 to prompt the activation of the power actuator 130. This results in the toe board 120 being repositioned from its barrier position (perpendicular to the mezzanine 122 floor) to its open position where the toe board 120 is parallel with the mezzanine floor (See FIG. 8). As the power actuator 130 is activated, the position of the piston 134 relative to the cylinder 132 is manipulated. In the case of the toe board 120 being repositioned from its barrier position to its open position, the power actuator 130 pivots clockwise at the second pivot point 138, and the piston 134 pivots counter-clockwise at the first pivot point 136. The opposite occurs when the sensor 126 detects the position of the load-in side gate 76' as closely approximating its barrier position as the toe board 120 is repositioned from its open position to its barrier position by reverse actuation of the power actuator 130 (as shown in FIG. 7).

As discussed above, the power actuator 130 may be an electromechanical actuator operatively coupled to a hydraulic, pneumatic or electromagnetic cylinder and piston; or may be a servo motor actuator operatively coupled to a rotary device without departing from the scope and spirit of the present invention. Likewise, the toe board 120 is shown as matching the contour of the mezzanine 122, however, the precise orientation of the toe board to match the precise contour of the mezzanine 122 on two surfaces is not critical to the novelty of the present invention. Further, while the toe board 120 has been explained as being oriented perpendicular with the floor of the mezzanine 122 while in its barrier position, the relative position of the toe board 120 to the floor does not necessitate a perpendicular orientation. The barrier 116 is operative if it inhibits lateral movement along the floor of the mezzanine. This inhibition may be accomplished by utilizing angles of less than 90 degrees when comparing the orientation of the toe board 120 to the floor.

Figure 9:
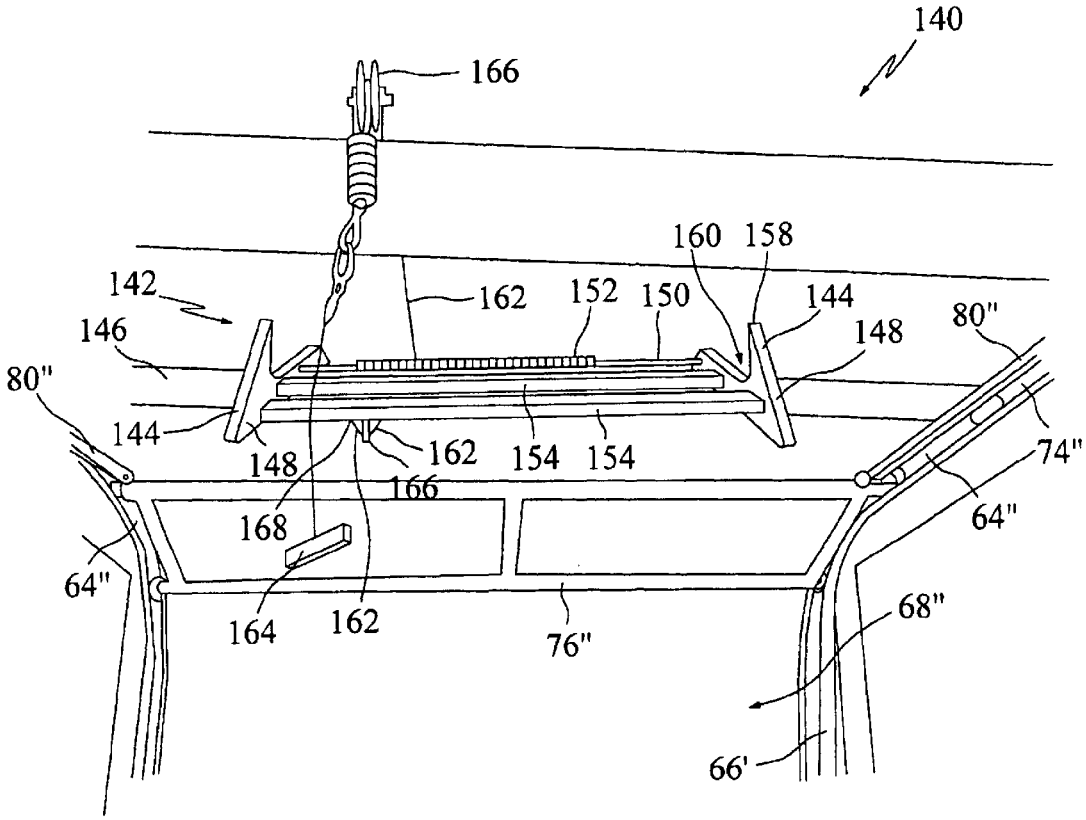
FIG. 9 is a frontal perspective view, from below, of a first exemplary lock in accordance with another aspect of the present invention.
Figure 10:
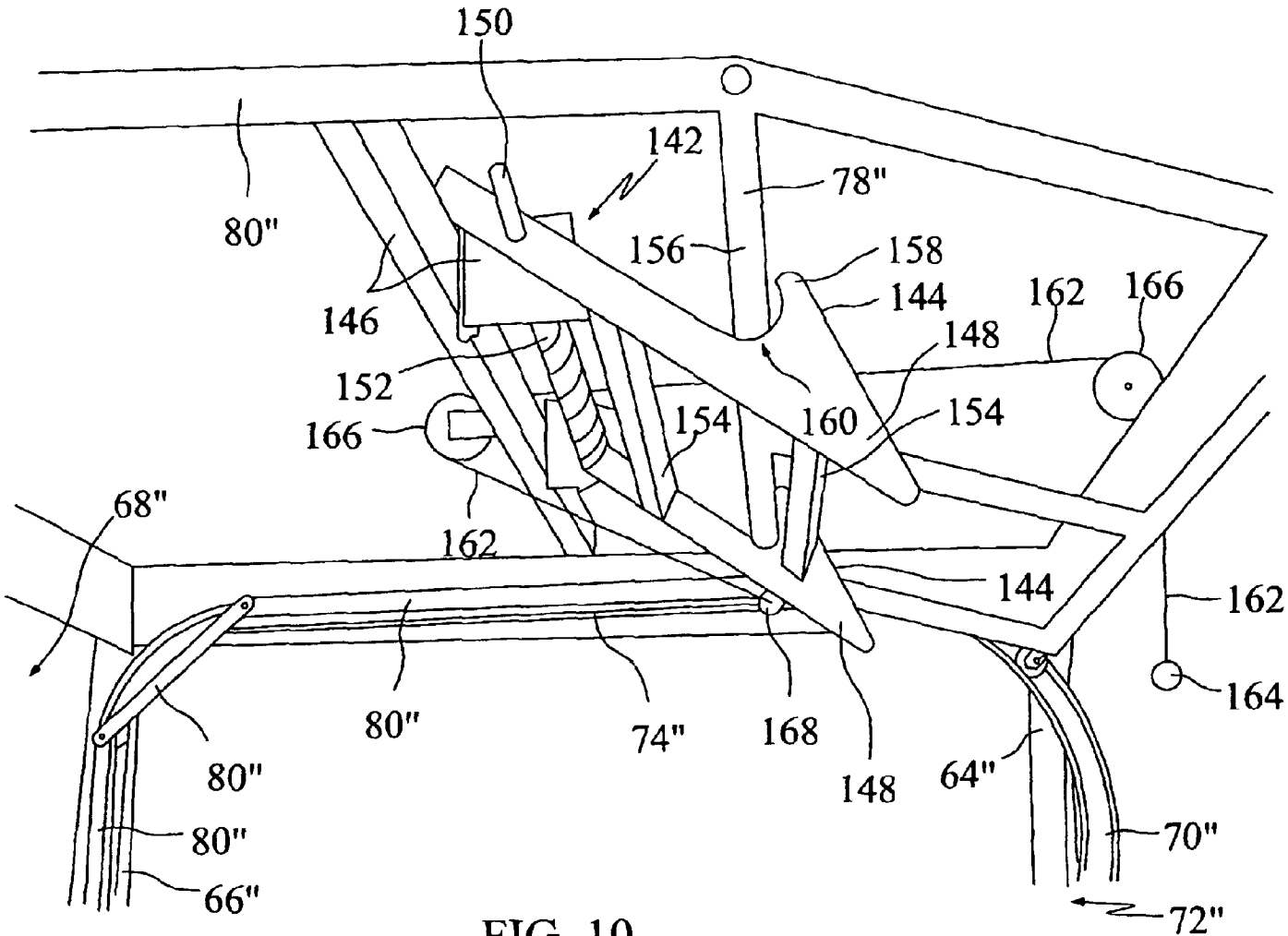
FIG. 10 is a left-side perspective view, from below, of the first exemplary lock in accordance with another aspect of the present invention.

As shown in FIGS. 9 and 10, a third exemplary embodiment of a barrier assembly 140 is shown with a lock assembly 142 to lock the load-in side gate 76" in its barrier position. The barrier assembly 140 includes the pair of parallel guide rails 64" that are shaped generally as an inverted-U and have the first substantially vertical portion 66" approximate the load-in side 68" of the elevated loading platform or mezzanine, the second substantially vertical portion 70" approximate the handling entrance side 72" of the elevated loading platform or mezzanine and the substantially horizontal portions 74" interconnecting the first and second substantially vertical portions 66", 70". The segmented cross-bar 80" is pivotally coupled between the loading side gate 76" and the handling side gate 78" such that the loading side gate 76" is in its barrier position when the handling side gate 78" in its open position, and vice versa.

The lock assembly 142 is mounted to a structural support 146 and includes a pair of cams 148 positioned within the path or point of travel of the handling side gate 78", approximate the open position of the handling side gate 78". Upon reciprocation of the handling side gate 78" from its barrier position to its open position, the handling side gate 78" will be captured by the recess 160 of the lock assembly 142. The pair of cams 148 pivot on a cylindrical shaft 150 having a torsion spring 152 coupled thereto to bias the cams 148 upwardly into the path of the handling side gate 78". The cams 148 are spaced apart by braces 154. When the handling side gate 78" is being reciprocated from its barrier to open position, an upper rail 156 of the handling side gate 78" abuts and thereafter rides upon the leading-edge, upper angled surfaces 144 of the cams 148. The spring-biased nature of the lock 142 allows the cams 148 to be displaced downwardly as the upper rail 156 passes thereover, but maintains contact between the cams 148 and the upper rail 156. As the upper rail 156 continues to slide over the cams 148, the bias of the lock is overcome, thereby continuing to apply a downward force upon the cam until the handling gate passes over a crest 158 at the top of the leading-edge, upper angled surface 144 of the cams 148 and falls into the trailing recess 160. After the upper rail 156 passes over the crest 158, the bias of the torsion spring 152 pushes the recess 160 upward to abut and capture the upper rail 156. This recess 160 substantially limits the movement of the handling side gate 78" back to its barrier position. Also, the shock absorbers or other stops (not shown) contacting the load-in side gate 76" limit further movement of the handling side gate 78" beyond its open position. Therefore, this recess 160 effectively locks the handling side gate 78" in its open position and the load-in side gate 76" in its barrier position.

The lock assembly 142 may be unlocked by pulling on a cable 162 (using a handle 164 attached to the end of the cable at the handling side of the barrier assembly). The cable 162 is threaded through a series of pulleys 166 and is coupled to the cams 148 at a coupling point 168 so that the cable pulls on the cams (when the handle 164 is pulled) and causes the cams 148 to pivot downwardly on the shaft 150, thereby overcoming the bias of the lock and releasing the upper rail 156 from the recess 160. This enables the handling side gate 78" to return in the direction toward its barrier position. As the lock 142 is spring-biased to the locking position, the locking feature will be automatically enabled again upon reciprocation of the load-in side gate 76" to its barrier position.

By positioning the unlocking handle 164 on the handling side of the barrier assembly, it is desired in this exemplary embodiment that personnel unlocking of the lock assembly 118 should not be able do so approximate the load-in side 68", but be positioned on the handling side 72" or outside of the loading area 60". By positioning the handle 164 in such a manner, this exemplary embodiment limits the ability of a single operator to defeat the lock and open the loading-side gate 76" while in the loading area or near the load-in side opening.

Figure 11:
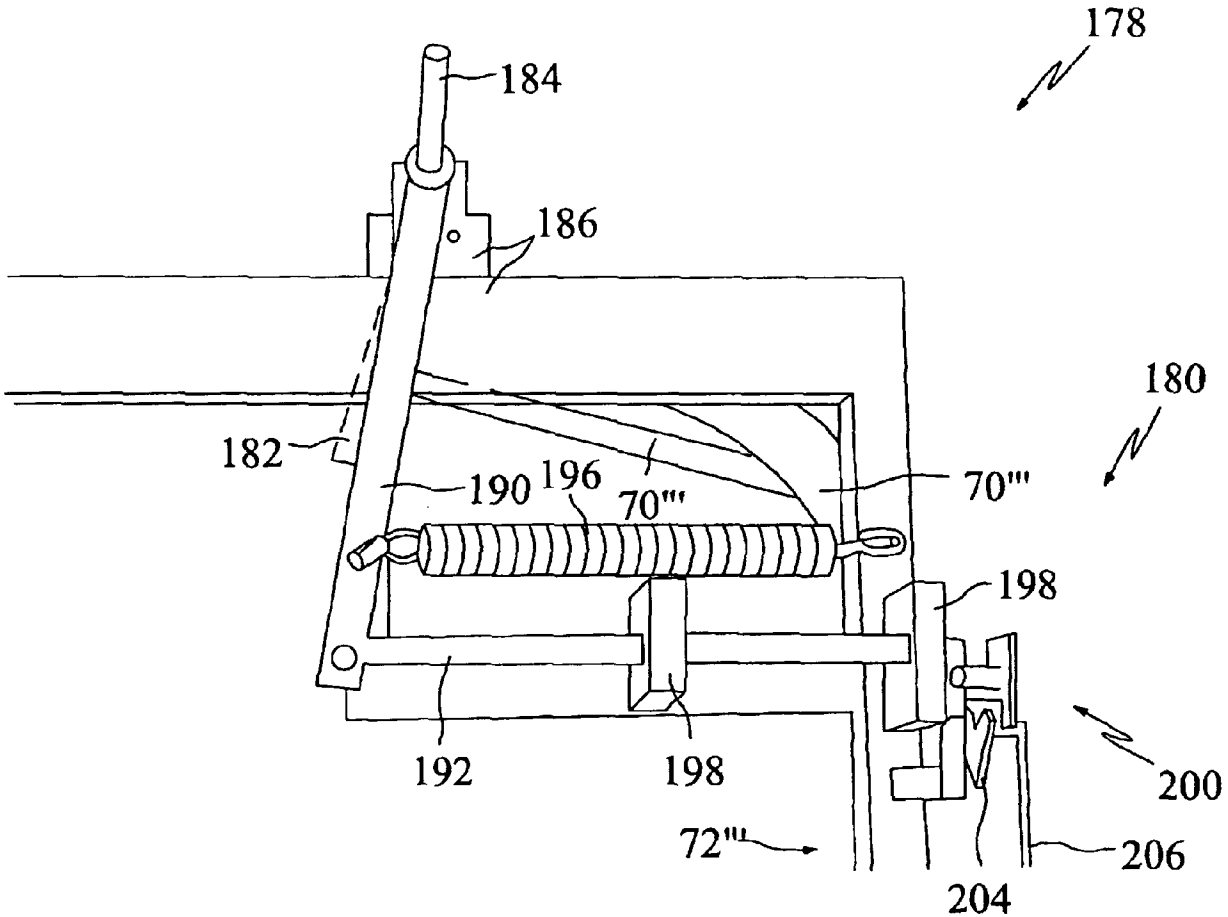
FIG. 11 is a left-side perspective view of a second exemplary lock in accordance with another aspect of present invention.
Figure 12:
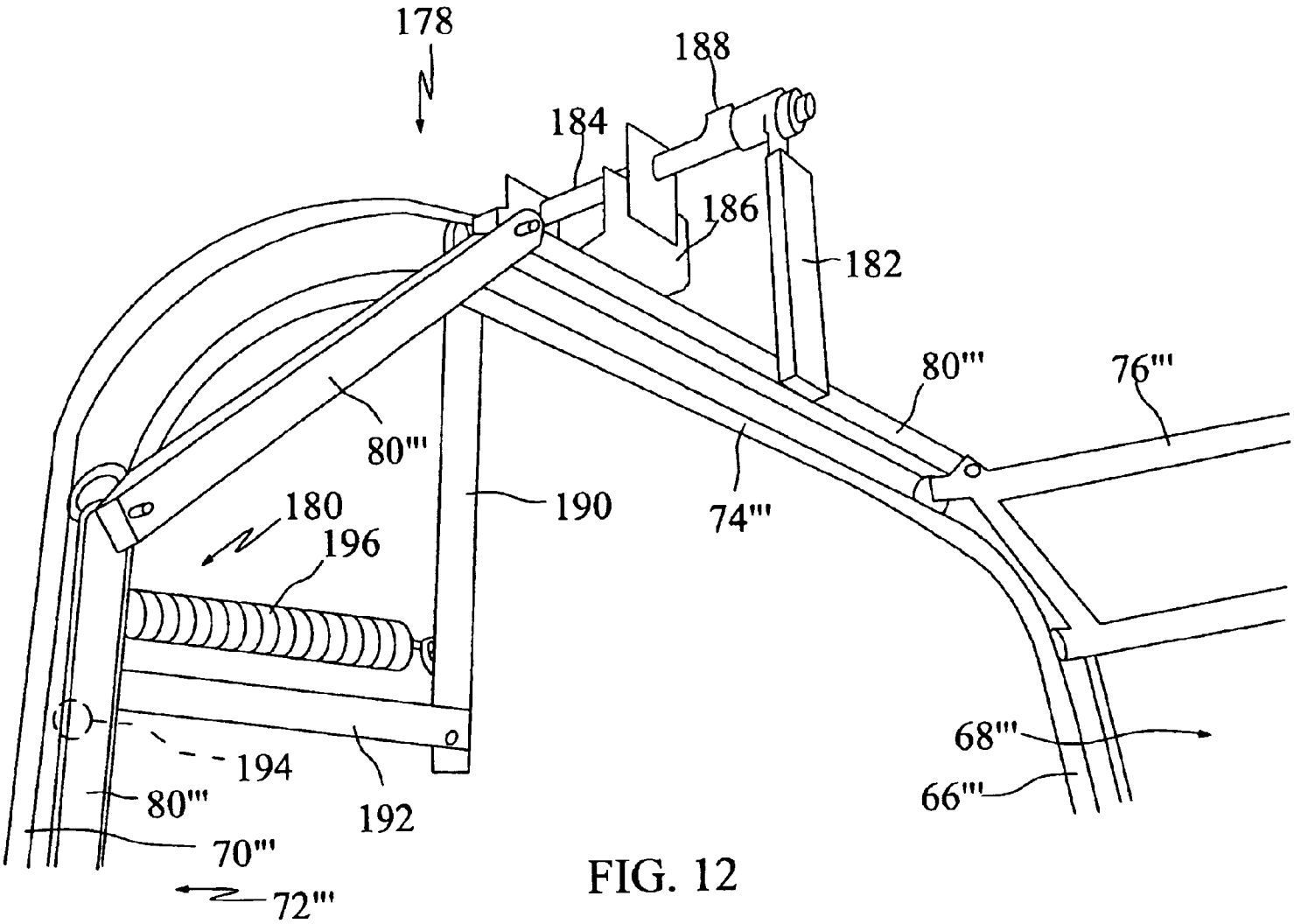
FIG. 12 is a right-side perspective view of the second exemplary lock in accordance with another aspect of the present invention.
Figure 13:
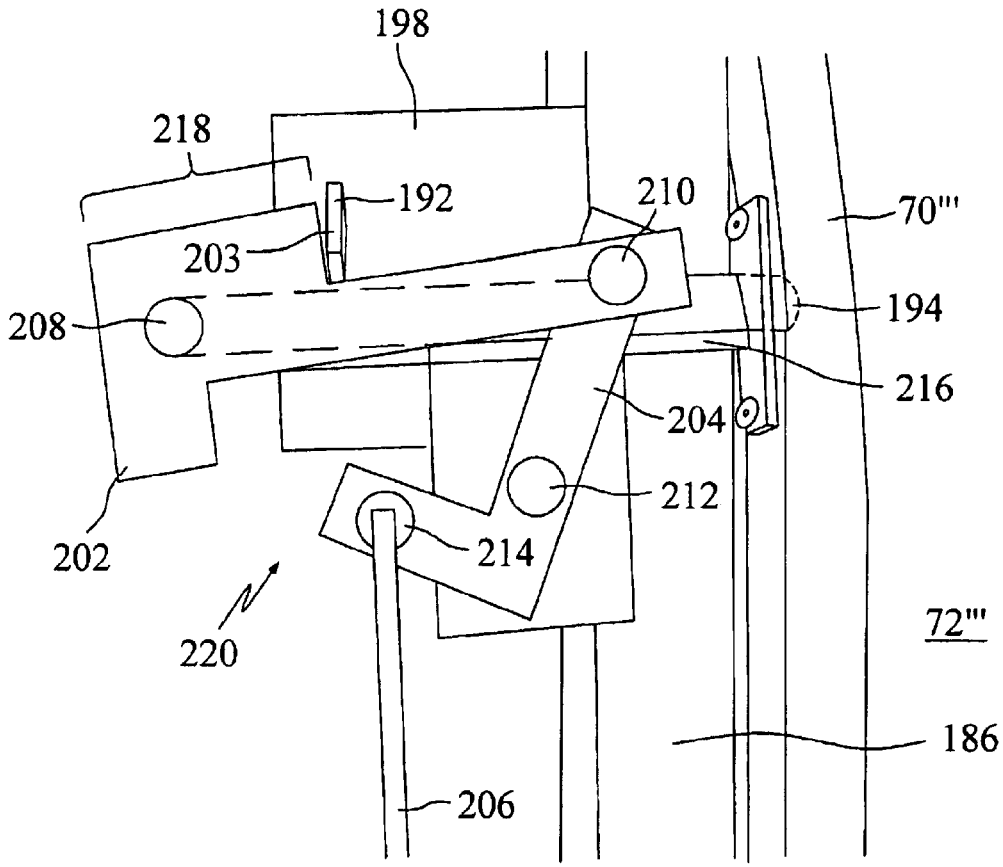
FIG. 13 is a frontal perspective view of the second exemplary locking mechanism in accordance with another aspect of present invention.

Referencing FIGS. 11–13, a fourth exemplary embodiment 178 includes an alternate locking assembly 180. The locking assembly 180 is engaged when the handling side gate 78"' is repositioned from its barrier position to its open position. A paddle 182, positioned in the path of the handling side gate 78"', approximate the open position of the handling side gate 78"', is freely rotatable for at least 90 degrees of clockwise movement about a rod 184 mounted to support structure 186, and includes a lip (not shown) that engages a tab 188 on the rod 184 to rotate the rod 184 in a counter clockwise direction (in relation to the paddle 182) to correspond with the direction of the paddle 182 as it is contacted by the handling side gate 78"' (See FIG. 12). As the rod 184 is rotated in the counterclockwise direction, a moment arm 190 affixed to the rod 184 pulls rearward a horizontal shaft 192 pivotally mounted thereto, to allow a bolt 194 to project into the C-channel of the rail 70"' (as will be described further below), approximate the barrier position of the handling side gate to limit the travel of the handling side gate 78"' downwardly from its open position.

Referring specifically to FIG. 11, a spring 196 mounted between the moment arm 190 and to the support structure 186 is in tension and constantly exerting a forward pulling force (clockwise in relation to the paddle 182) upon the moment arm 190, thus, resulting in a forward pulling force on the horizontal shaft 192. Guide blocks 198 are utilized to maintain the proper plane and elevation of the horizontal shaft 192 as it moves forward or rearward.

Referring FIGS. 12 and 13, a release mechanism 200 utilizes the horizontal shaft 192 to engage a latch 202, which is pivotally coupled to the bolt 194, to maintain the locking mechanism in its unlocked configuration (where the bolt 194 is withdrawn from the C-channel of the rail 70'''). In the engaged orientation shown in FIG. 13, the latch 202 is pulled away from the rail segment 70''', which in turn pulls the bolt 194 out of the C-channel of the rail segment 70'''. The leading end of the horizontal shaft 192 abuts a shoulder on the latch 202 to maintain the latch in its pulled-away orientation. The spring 196 (See FIG. 11) biases the horizontal shaft 192 forward into this engagement. Another spring (not shown) carried on the bolt 194, biases the bolt towards the C-channel of the rail segment 70'''. Therefore, when the paddle 182 is contacted by the handling side gate 78''' as the gate is repositioned to its open position (as discussed above), the horizontal shaft 192 is pulled back to disengage from the shoulder 203 of the latch, and consequently, the spring carried on the bolt 194 biases the bolt 194 into the C-channel of the rail segment 70''' to lock the handling side gate 78''' in its open orientation (since the bolt 194 will not allow the rollers on the gate traveling in the C-channel of the rail to move thereby). As the spring (not shown) on the bolt 194 pulls the bolt 194 forward into the channel, it also pulls the latch 202 forward in the same direction. As a result, in this orientation, the shoulder 203 is positioned beyond the leading end of the horizontal shaft 192, and the raised portion 218 of the latch 202 behind the shoulder 203 prohibits the biased horizontal shaft 192 from projecting forward.

Referring specifically to FIG. 13, an L-shaped lever 204 is pivotally mounted to the support structure at pivot point 212, and is pivotally coupled to the latch 202 at a first end 210 and is pivotally coupled to a vertical release rod 206 at its opposite end 214. The vertical release rod 206 is coupled to a foot-actuator (not shown), such that when the foot-actuator is activated by an operator, the vertical release rod 206 pulls downwardly on the end 214 of the L-shaped lever 204, to pivot the lever in a counter-clockwise direction such that the first end 210 of the lever pushes the latch 202 away from the rail 70''', and in turn pulls the bolt 194 out from the C-channel of the rail 70''', unlocking the locking mechanism and allowing the handling side gate 78''' to be guided back to its barrier position. When the latch is pushed away from the rail 70''' upon activation of the foot actuator, the shoulder 203 moves past the horizontal shaft 192 causing the horizontal shaft 192 to be biased forward again to engage the shoulder 203 (as shown in FIG. 13), thereby maintaining the bolt 194 in its unlocked orientation until the paddle 182 is contacted again by the gate 78''' as discussed above.

By positioning the unlocking foot actuator (not shown) on the handling side 72''' of the barrier assembly 178, it is desired in this exemplary embodiment that personnel unlocking of the lock assembly 180 should not be able do so approximate the load-in side gate 76''', but be positioned on the handling side 72''' or outside of the loading area 60'''. By positioning the foot actuator in such a manner, this exemplary embodiment limits the ability of a single operator to defeat the lock and open the loading-side gate 76''' while in the loading area or near the loading-side gate 76'''.

Figure 14:
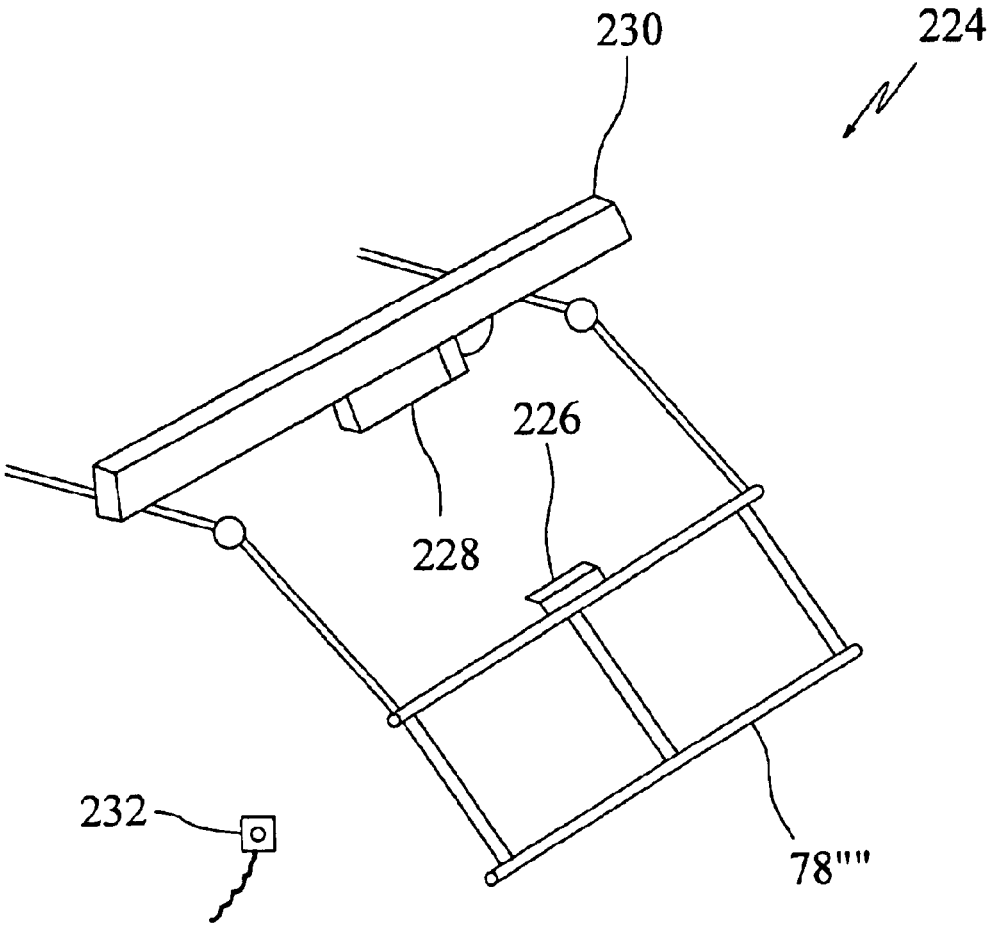
FIG. 14 is an elevated perspective view of a third exemplary lock in accordance with another aspect of present invention.
Figure 15:
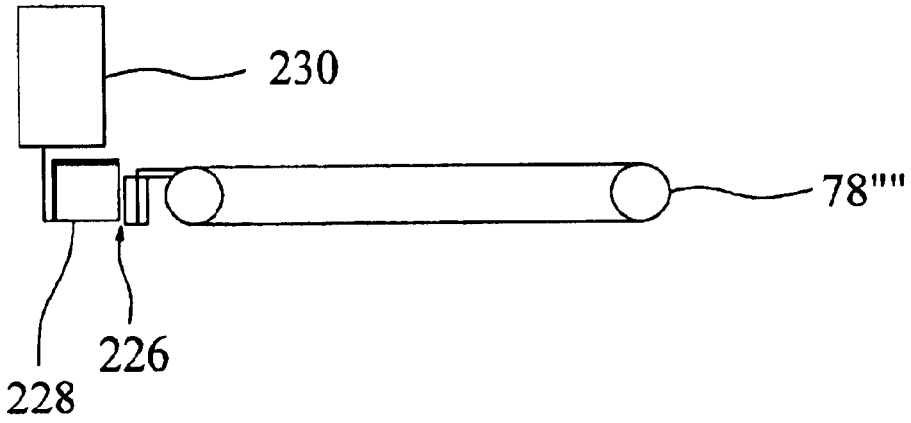
FIG. 15 is a schematic illustration of a profile view of the third exemplary lock in accordance with another aspect of present invention.

Referencing FIGS. 14–15, a fifth exemplary embodiment includes an alternate locking assembly 224. The locking assembly 224 is engaged when the handling side gate 78'''' is repositioned from its barrier position to its open position. An armature plate 226, mounted to the handling side gate 78'''', is positioned to engage an electromagnet 228 of a magnetic lock 230 mounted to the support structure (not shown). As the handling side gate 78'''' is repositioned from its barrier position to its open position, the armature plate 226 is brought into proximity with the electromagnet 228 of the magnet lock 230. The electromagnet 228 is energized to create a magnetic field approximate the magnetic lock 230, which exerts a pulling force upon the armature plate 226 and also the handling side gate 78'''' tending to pull the armature plate toward the electromagnet 228. When the position of the armature plate 226 approximates the electromagnet 228, the pulling force is sufficient to pull the armature plate 226 into an abutting or secured position with the electromagnet 228, thereby locking the armature plate 226 and the handling side gate 78'''' into its open position (See FIG. 15).

Referring specifically to FIG. 14, a power interrupting button 232 is positioned outside of the barrier assembly to temporarily discontinue power to the electromagnet 228. This interruption results in the electromagnet 228 no longer generating a magnetic field sufficient to maintain the position of the handling side gate 78'''' when an attempt is made to reposition the gate 78'''' from its open position to its barrier position. The duration of the interruption may be manipulated based upon various operating conditions. For instance, some personnel repositioning the gate 78'''' may be able to reposition the gate in approximately two seconds after the power interruption button 232 is activated. However, other personnel may require a longer interruption along the lines of five or ten seconds. As the gate 78'''' approximates its barrier position, the gate 78'''' makes contact with a switch (not shown) to discontinue power to the electromagnet 228 until the gate 78'''' is repositioned approximate its open position and no longer contacts the switch, thereby providing power to the electromagnet 228.

Figure 16:
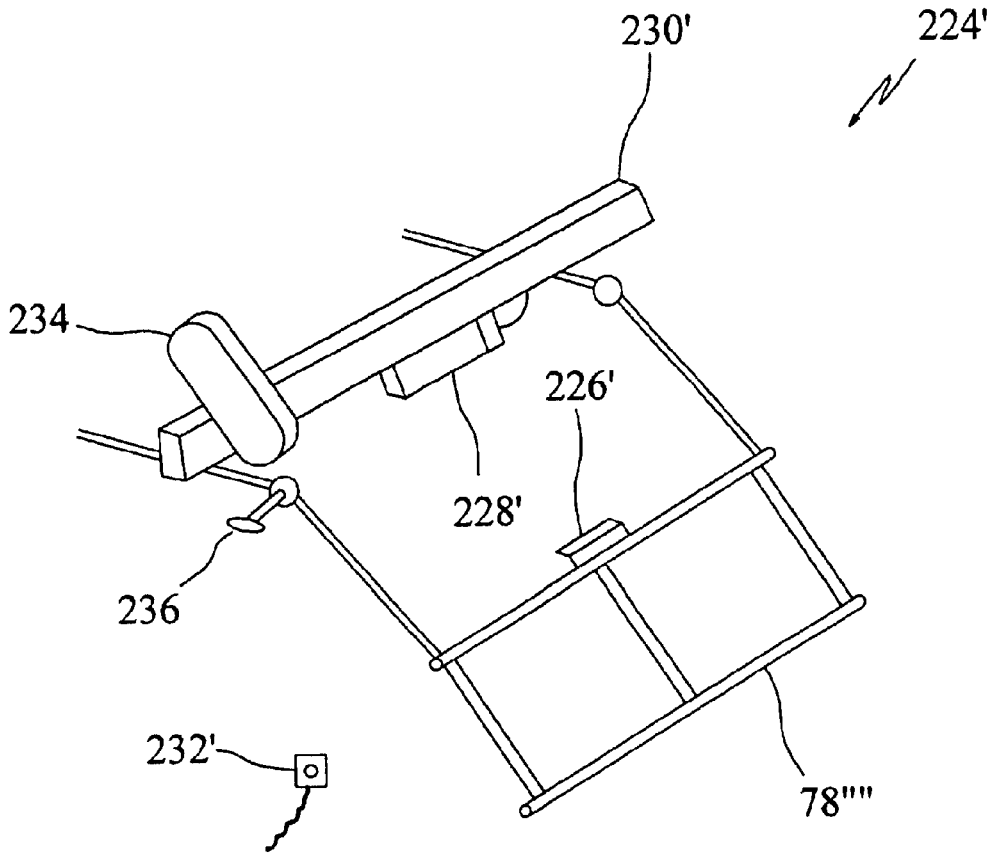
FIG. 16 is an elevated perspective view of a fourth exemplary lock in accordance with another aspect of present invention.
Figure 17:
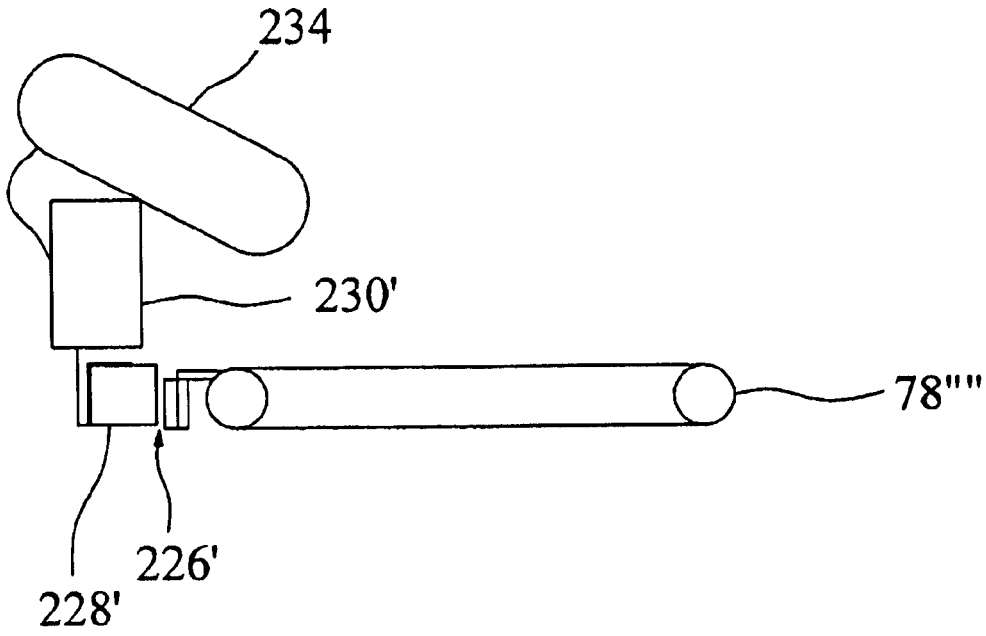
FIG. 17 is a schematic illustration of a profile view of the fourth exemplary lock in accordance with another aspect of present invention.

Referencing FIGS. 16–17, it is also within the scope of the invention to provide a variation of the fifth exemplary embodiment having a sensor 234 to detect the movement of the gate 78'''', rollers 236, and/or armature plate 226'. In sensing one or more of the aforementioned in a position consistent with the handling side gate 78'''' approximating its open position, the sensor 234 closes a switch that energizes the electromagnet 228. As the armature plate 226' approximates the electromagnet 228', the armature plate 226' is pulled toward the electromagnet 228' and into an abutting or secured position with the electromagnet 228'. In this alternate exemplary embodiment, a similar power interruption button 232' may be utilized to interrupt the power energizing the electromagnet 228' while concurrently blocking the sensor 234 from closing the switch. Therefore, when repositioning of the handling side gate 78'''' is desired, personnel simply activates the power interruption button 232' to discontinue power to the electromagnet for a set duration. Generally, a duration of ten seconds gives the personnel enough time to reposition the handling side gate 78'''' from its open position to its barrier position such that after ten seconds has elapsed the sensor no longer detects the handling side gate 78'''' approximating its open position and discontinues closing the switch. Thereafter, the cycle starts again.

It is to be understood that while the above exemplary locking mechanisms have made reference to a foot pedal, a pull cord, a button or an actuator to unlock the locking mechanisms, other devices are contemplated for use in the present invention such as simple remote controls in motorized applications and equivalents of manual disengagement.

Figure 18:
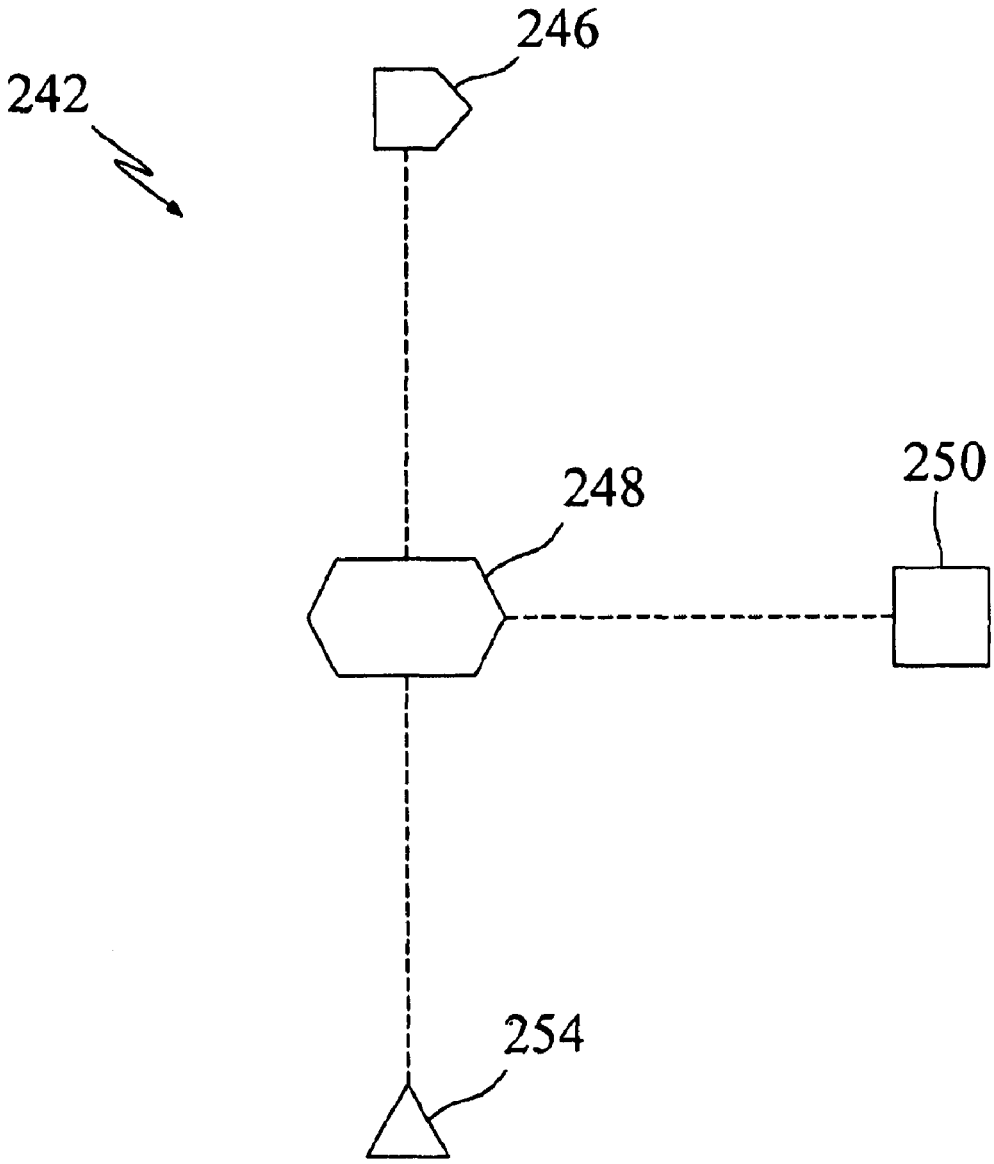
FIG. 18 is a schematic diagram of a second exemplary control system in accordance with an aspect of the present invention.
Figure 19:
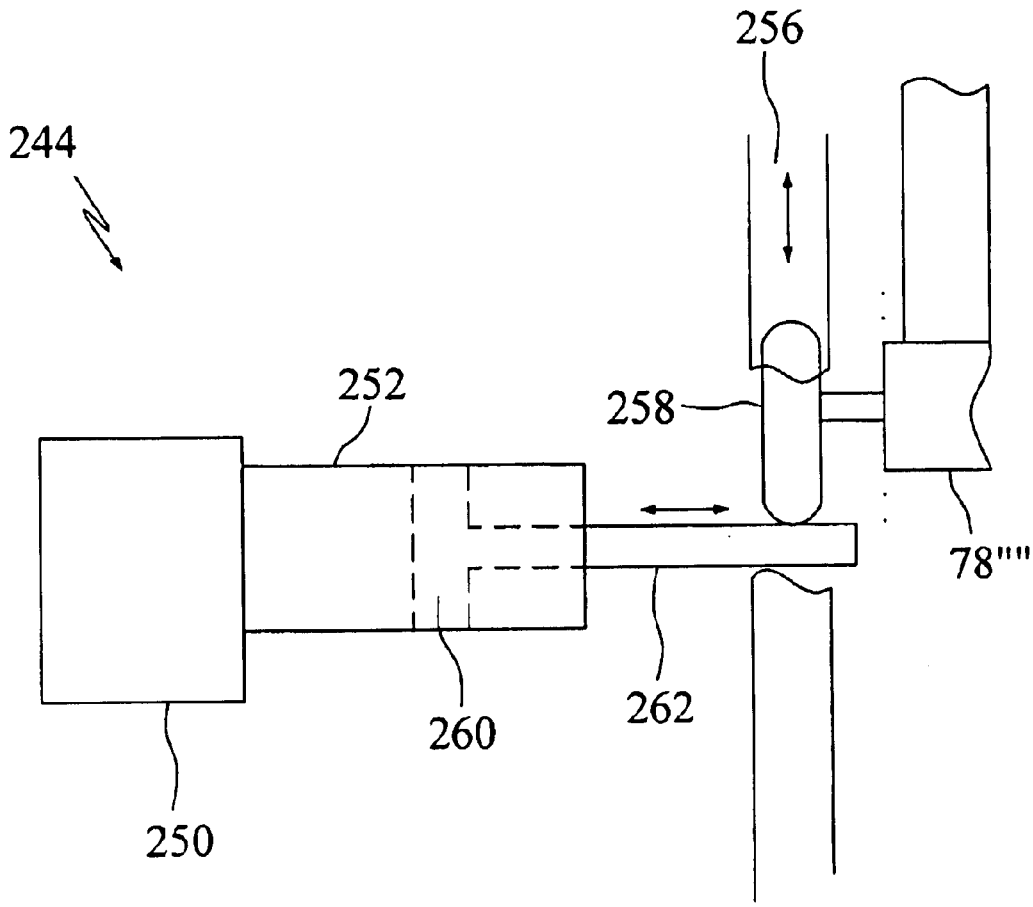
FIG. 19 is a profile view of a fifth exemplary lock in accordance with another aspect of present invention.

Referencing FIGS. 18–19, a sixth exemplary embodiment includes an alternate locking assembly to lock the load-in side gate it its barrier position and likewise lock the handling side gate 78"" in its open position. A control system 242 is operatively coupled to a powered lock 244 to enable or prohibit the repositioning of the gates from their open to barrier positions, and vice versa. Referencing specifically FIG. 18, the control system 242 includes a sensor 246 that is operatively coupled (shown in dashed lines) to a control circuitry 248 that is also operatively coupled to a powered actuator 250 coupled to a pneumatic cylinder 252. In addition, the control system 242 includes an unlocking device 254 operatively coupled to the control circuitry 248. The sensor 246 may provide constant or intermittent feedback to the control circuitry indicating the position of one of the gates, or may provide constant or intermittent feedback to the control circuitry 248 in the sense of a true/false response to a query. A first exemplary query may be whether the load-in side gate is in its barrier position or so closely approximates its barrier position to warrant locking the gates in their respective positions. A second exemplary query may be whether the handling side gate 78"" is in its open position or so closely approximates its open position to warrant locking the gates. As the control circuitry 248 receives and/or sends signals to the sensor 246, the control circuitry 248 is configured to respond to variations in signals received from the sensor 246 and the unlocking device 254. The control circuitry 248 recognizes signals from the unlocking device 254 as dominant over signals received from the sensor 246.

Citing FIG. 19, the powered lock 244 is operatively coupled (not shown) to a rail 256, which is in turn coupled to the gates by way of rollers 258. The powered lock 244 is mounted to a support structure (not shown) so as to place a bolt 262 perpendicular to the line of the travel of the rollers 258 when the locking feature is desired. As the handling side gate 78"" is repositioned from its barrier position to its open position, the sensor 246 relays this change in position information to the control circuitry 248 to prompt the activation of the powered actuator 250. As the power actuator 250 is activated by the control circuitry 248, the position of a piston 260 relative to a pneumatic cylinder 252 is manipulated so as to either extend the bolt 262 coupled to the piston 260 perpendicularly into the line of travel the rollers 258, or withdraw the bolt 262 from the line of travel of the rollers 258. In positioning the bolt perpendicularly in relation to the path of the rollers 258, the bolt 262 acts as a lock inhibiting the movement of rollers 258 in at least one direction, and thus, the gates from being repositioned from their open and barrier positions to their respective barrier and open positions. When the locking feature is no longer desired, the unlocking device 254 is utilized to send a signal to the control circuitry 248 and ultimately the power actuator 250 to withdraw the bolt from the line of travel of the rollers 258, thereby enabling repositioning of the gates. The unlocking device 254 may be a simple manual button positioned outside of the barrier assembly, or may be an infrared transmitter necessitating a line of site obtainable only while outside of the barrier assembly.

As discussed above, the power actuator 250 may also be a servo motor actuator operatively coupled to a rotary device without departing from the scope and spirit of the present invention. Likewise, the precise orientation of the bolt 262 inhibiting the movement of the rollers 258 along the rail 256 is not critical to the novelty of the present invention. Further, while the bolt 262 has been explained as being oriented perpendicularly to the line of travel of the rollers 258, the relative position of the bolt 262 to the rollers 258 does not necessitate a perpendicular orientation as the locking feature is simply brought about by inhibiting movement of the rollers 258 in at least a single direction. Orienting the bolt other than perpendicular or at a 90 degree angle may also bring about this inhibition.

It is to be understood by one of ordinary skill in the art that while some of the aforementioned explanations do not make reference to the position of a load-in side gate 76", 76"', 76"" in relation to the position of the handling side gate 78", 78"', 78"", the handling side gate is in its open position when the load-in side gate 76", 76"', 76"" is in its closed position, and vice versa.

Figure 20:
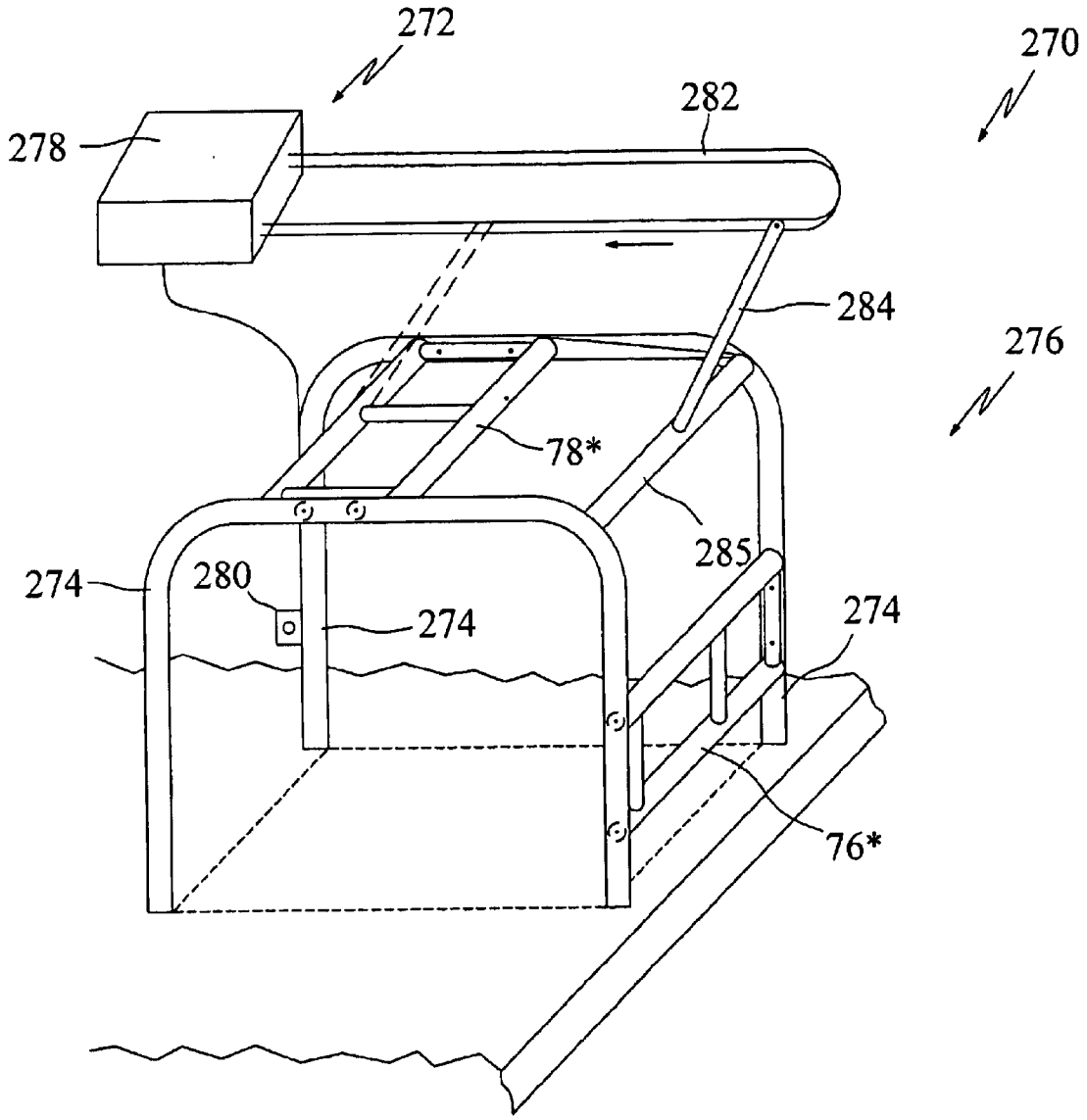
FIG. 20 is an elevated perspective view of an exemplary motorized assembly for a barrier assembly in accordance with another aspect of the present invention.

Referencing FIG. 20, a seventh exemplary embodiment 270 is shown with a motorized drive assembly 272. The motorized drive assembly 272 may be positioned above the guide rails 274 of the barrier assembly 276 so as not to obstruct the area between the pair of guide rails 274.

In this exemplary embodiment, the motorized drive assembly 272 includes a drive track, such as a belt 282, driven by a motor 278 to reciprocate a coupling assembly 284 back and forth along a track. The coupling assembly is mounted to a bar 285 extending laterally between parallel segments of the segmented cross bar, which is in turn coupled between the load-in side gate 76* and the handling side gate 78*. The motor 278, controlled by the control panel 280, is operative to move the gates between their respective barrier and open positions by driving the coupling assembly 284 back and forth along the drive track. The control panel 280 is positioned, in this embodiment, approximate the handling side of the barrier assembly. It is desired with this embodiment that when the load-in side gate 76* is in its barrier position and the handling side gate 78 is in its open position, the gates will only be able to be driven by the motor back to their respective open and barrier positions upon manual activation of a control panel 280 control. Thus, the motorized drive assembly 272 acts to lock the barrier assembly when the load-in side gate 76* is in its barrier position and the handling side gate 78* is in its open position as with the various embodiments discussed above.

It should be apparent to those of ordinary skill in the art that the components or methods of the above motorized drive assembly may be replaced without departing from the scope and spirit of the present invention. For example, the coupling assembly 214 could be mounted to the load-in side gate 76* or the handling side gate 78* or may be mounted to a cable coupled between the gate segments if a cable-pulley coupling is used instead of the cross-bar couplings. Also, the drive track may be a chain, cables or other article that helps facilitate reciprocation of the coupling assembly 214 and, in turn, the load-in side gate 76* and the handling side gate 78*.

Figure 21:
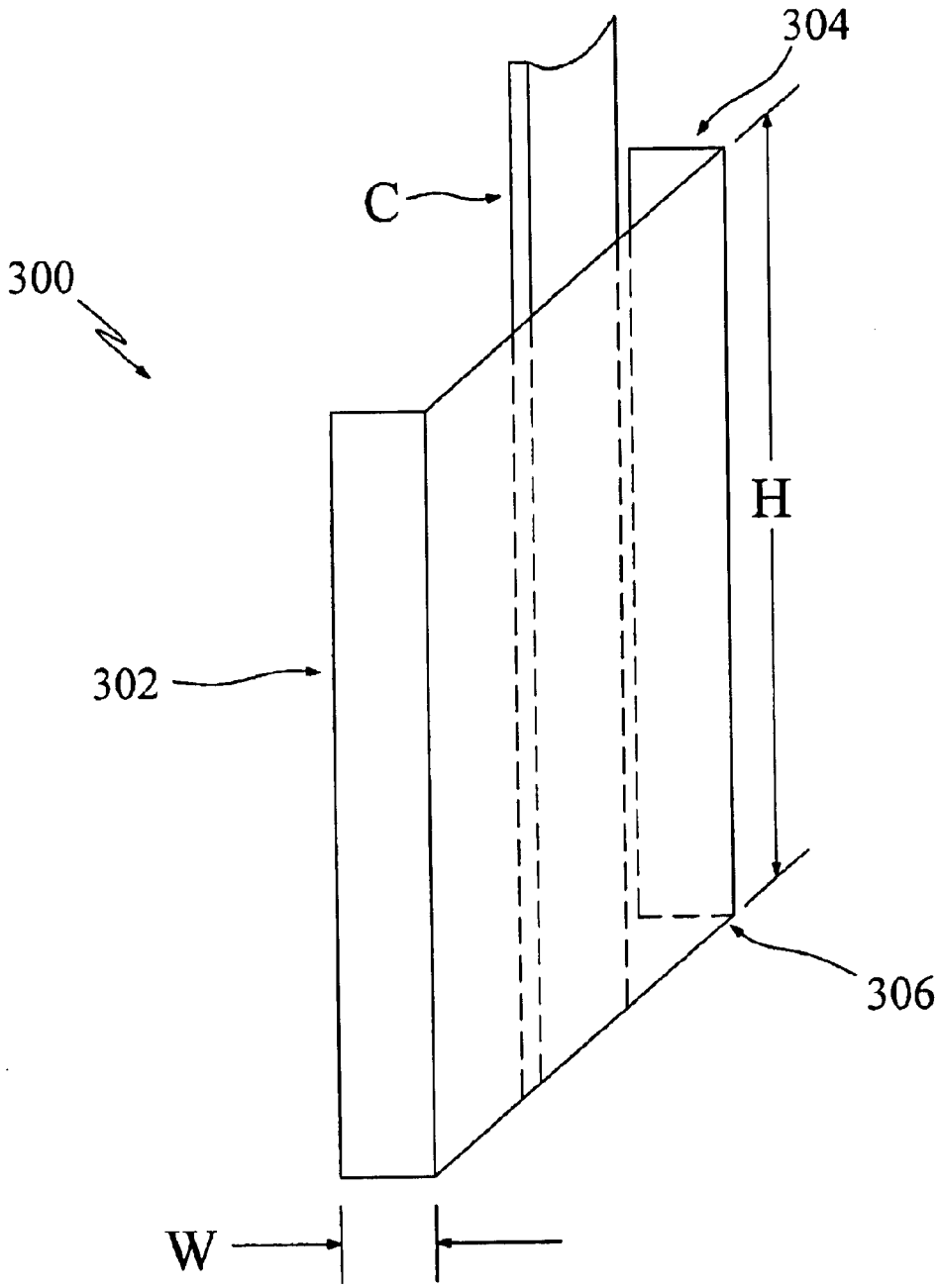
FIG. 21 is an elevated perspective view of an exemplary protection device for a barrier assembly in accordance with another aspect of the present invention.
Figure 22:
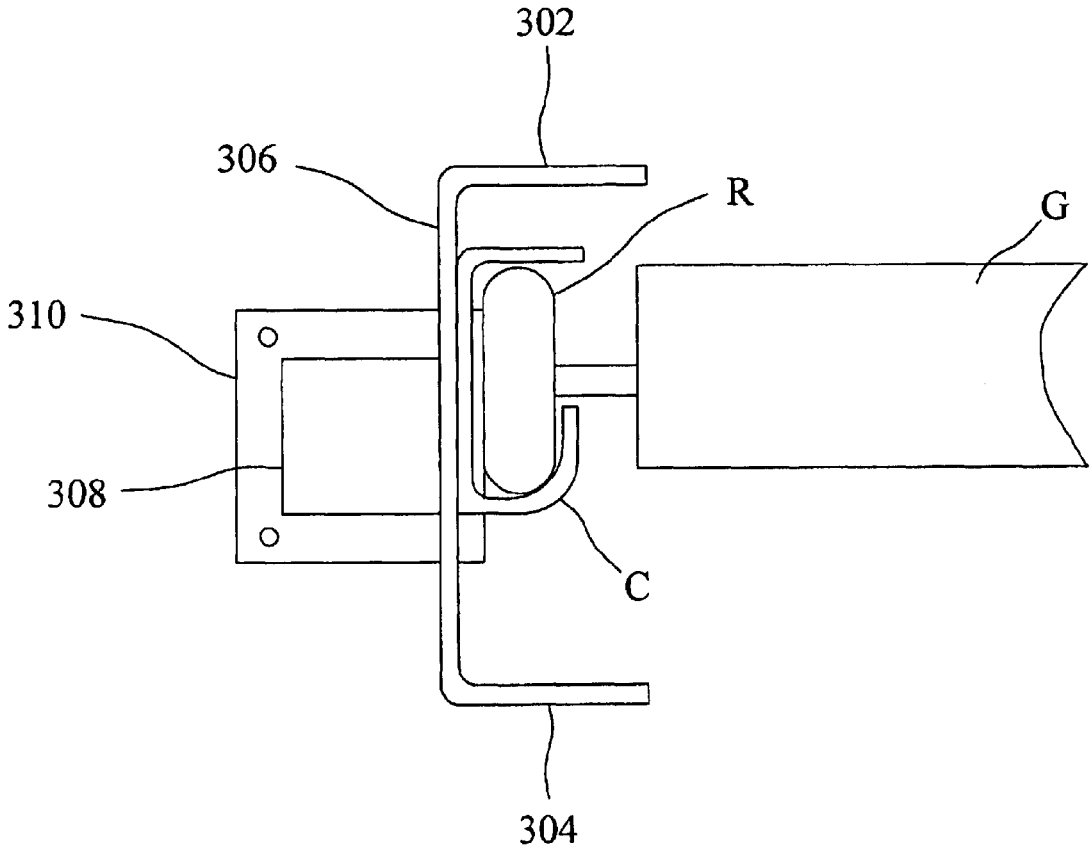
FIG. 22 is a cross-sectional view of the exemplary protection device for a barrier assembly in accordance with another aspect of the present invention.

Referencing FIGS. 21–22, it is also within the scope and spirit of the present invention to provide guard plates 300 to provide protection to the C-channels guiding the rollers R coupled to the gates G as well as providing a support structure to one or more of the aforementioned exemplary embodiments. The guard plates may generally be block-C shaped having a proximal protection side 302, a lateral protection side 304 parallel to the proximal protection side 302, and a medial side 306 perpendicular to the proximal protection side 302 and the lateral protection side 304. It is envisioned that the guard plates 300 are mounted to the rails and/or mounted to an independent support 308, such as a support column 308 having a floor mounted plate 310. Exemplary dimensional guidelines of a guard plate in accordance with the present invention includes sides 302, 304 being between 2 to 6 inches wide W and approximately 48 inches in height H. The length of the medial side 306 is similarly a variable and most notably is dependent upon the dimensions of articles one desires to protect. For example, the length of the medial side in accordance with the first exemplary embodiment might be greater than that in accordance with the second exemplary embodiment, or vice versa.

It is further within the scope and spirit of the present invention to provide one or more guide rails for the gates of the present invention to travel. Additionally, it is also within the scope and spirit of the present invention to provide tubular rails, T-shaped rails, I-shaped rails or virtually any other rail configuration enabling guidance to the rollers and/or gates.

It is yet a further aspect of the present invention that the cross-bars or connectors 80, 80", utilized between the gate segments may be segmented and pivotally connected, as well as utilizing cables and pulleys to connect the gate segments. It is also within the scope and spirit of the present invention to place stops or shock absorbers at each bottom portion of the guide rails to limit downward movement of the associated gate segments to their respective barrier positions.

It will also be within the scope of the present invention to combine any of the various embodiments (or any aspects from the various embodiments) described herein as desired.

Following from the above description and invention summaries, it should be apparent to those of ordinary skill in the art that, while the methods and apparatuses herein described constitute exemplary embodiments of the present invention, it is to be understood that the inventions contained herein are not limited to these precise embodiments and that changes may be made to them without departing from the scope of the inventions as defined by the claims. Additionally, it is to be understood that the invention is defined by the claims and it not intended that any limitations or elements describing the exemplary embodiments set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A barrier assembly for protecting an edge of a loading platform comprising:

a gate reciprocating between a barrier position adapted to be approximate an edge of a loading platform and an open position adapted to be away from the edge of the loading platform; and, a toe barrier adapted to be mounted approximate the edge of the loading platform and operatively coupled to the gate to reciprocate between a barrier position, which is adapted to provide a vertical barrier along a floor of the loading platform approximate the edge of the loading platform, and an open position, which substantially removes the vertical barrier;

the toe barrier being operatively coupled with the gate to reciprocate to its barrier position when the gate is in its barrier position and to reciprocate to its open position when the gate is in its open position.

2. The barrier assembly of claim 1, wherein the toe barrier is substantially planar and is adapted to be pivotally mounted along the floor of the loading platform to lie substantially horizontal with the floor of the loading platform while in its open position and to extend substantially perpendicular with the floor of the loading platform while in its barrier position.

3. The barrier assembly of claim 2, wherein the gate is guided between its respective barrier and open positions by at least one guide rail.

4. The barrier assembly of claim 2, wherein the toe barrier spans below the gate, substantially a horizontal distance of the gate when the gate is in its barrier position.

5. The barrier assembly of claim 2, further comprising:

a lever pivotally mounted to a stationary support, having a first end coupled to the toe barrier and a second end biased into a path of the gate approximate the gate's barrier position, and operative to pivot in a first direction when the second end is contacted by the gate, adapted to thereby cause the first end to lift the toe barrier to its substantially perpendicular position with respect to the floor of the loading platform, and operative to pivot in an opposite direction when the second end loses contact with the gate, thereby causing the second end to drop the toe barrier to its substantially horizontal position;

whereby the lever operatively couples the toe barrier to the gate to reciprocate the toe barrier to its barrier position when the gate is in its barrier position and to reciprocate the toe barrier to its open position when the gate is in its open position.

6. The barrier assembly of claim 2, further comprising:

a drive mounted to a support on a first end and mounted to the toe barrier and a second end, and operative to lift the toe barrier to its substantially perpendicular position with respect to the floor of the loading platform, and operative drop the toe barrier to its substantially horizontal position; and, a sensor for detecting the position of the gate and relaying a signal to a control circuit operatively coupled to the drive and the sensor, whereby the control circuit operatively couples the toe barrier with the gate to reciprocate the toe barrier to its barrier position when the gate is in its barrier position and to reciprocate the toe barrier to its open position when the gate is in its open position.

7. The barrier assembly of claim 6, wherein:

the drive includes:

a first actuator, a first cylinder operatively coupled to the first actuator, and a first piston partially within the first cylinder and mounted to the toe plate, wherein the first actuator receives an activation signal from the control circuit to reposition the first piston within the first cylinder in one of a first or second direction to bring about the reciprocation of the toe barrier to its barrier position when the gate is in its barrier position and to reciprocate the toe barrier to its open position when the gate is in its open position.

8. The barrier assembly of claim 7, wherein the first cylinder is at least one of hydraulic, pneumatic, and electromagnetic.

9. A barrier assembly for protecting a loading platform, the loading platform having a loading edge and a personnel entrance distal from and substantially parallel to the loading edge, the barrier assembly comprising:

a pair of parallel guide rails, each having a first substantially vertical portion, a second substantially vertical portion opposite the first substantially vertical portion and an elevated substantially horizontal portion operatively interconnecting the first and second substantially vertical portions;

a first gate segment having at least one pair of rollers positioned on opposite lateral sides thereof, each roller being received by a respective one of the guide rails so that the first gate segment is guided by the pair of guide rails, the first gate segment being guided by the pair of guide rails from an upper first-side barrier position in which the first gate segment is positioned within the first substantially vertical portions of the pair of guide rails to a first-side open position in which the first gate segment is positioned at least partially within the substantially horizontal portions of the pair of guide rails; and, a toe barrier spanning at least a portion of the distance between lower ends of the first substantially vertical portions of the guide rails, operative to arrive at a lower first-side barrier position, below the upper first-side barrier position, while the first gate segment is approximate its upper first-side barrier position, and operative to return to an open position while the first gate segment is approximate its first-side open position.

10. The barrier assembly of claim 9, further comprising an automatic lock operative to lock the first gate segment in its upper barrier position.

11. The barrier assembly of claim 10, wherein the lock includes a manual actuator for deactivating the lock, the manual actuator adapted to be positioned approximate a personnel entrance of a loading platform.

12. The barrier assembly of claim 9, further comprising:

a second gate segment having at least one pair of rollers positioned on opposite lateral sides thereof, each roller being received by a respective one of the guide rails so that the second gate segment is guided by the pair of guide rails, the second gate segment being guided by the pair of guide rails from a second-side barrier position in which the second gate segment is positioned within the second substantially vertical portions of the pair of guide rails to a second-side open position where the second gate segment is positioned at least partially within the substantially horizontal portions of the pair of guide rails; and, a coupling assembly operatively coupling the first gate segment and the second gate segment, such that the first gate segment is in its upper first-side barrier position when the second gate segment is in its second-side open position and such that the first gate segment is in its first-side open position when the second gate segment is in its second-side barrier position.

13. The barrier assembly of claim 12, wherein the coupling assembly includes at least one cable coupled between the first and second gate segments guided by at least one pulley mounted to a stationary support.

14. The barrier assembly of claim 12, wherein the coupling assembly includes at least one cross-bar pivotally connected between the first and second gate segments.

15. The barrier assembly of claim 12, wherein the coupling assembly includes a segmented cross-bar pivotally connected between the first and second gate segments.

16. The barrier assembly of claim 12, further comprising a stop to restrict the downward movement of at least one of:

the first gate segment substantially beyond its upper first-side barrier position; and, the second gate segment substantially beyond its second-side barrier position.

17. The barrier assembly of claim 16, wherein the stop includes a shock absorber to absorb at least a portion of a downward force of at least one of the first and second gate segments.

18. The barrier assembly of claim 9, wherein the toe barrier is substantially planar and is adapted to be pivotally mounted along a floor of a loading platform approximate a loading edge to lie substantially horizontal with the floor of the loading platform while in its open position and to extend substantially perpendicular with the floor of the loading platform while in its lower first-side barrier position.

19. The barrier assembly of claim 18, further comprising a lever pivotally mounted to a stationary support, having a first end coupled to the toe barrier and a second end biased into a path of the first gate segment approximate the upper first-side barrier position, and operative to pivot in a first direction when the second end is contacted by the first gate segment, thereby causing the first end to lift the toe barrier to its substantially perpendicular position with respect to the floor of the loading platform, and operative to pivot in an opposite direction when the second end loses contact with the first gate segment, thereby causing the second end to drop the toe barrier to its substantially horizontal position.

20. The barrier assembly of claim 18, further comprising a drive mounted to a support on a first end and coupled to the toe barrier, the drive adapted to be operative to lift the toe barrier to its substantially perpendicular position with respect to the floor of the loading platform when the first gate segment approximates its upper first-side barrier position, and adapted to be operative to drop the toe barrier to its substantially horizontal position when the first gate segment approximates its upper first-side open position.

21. The barrier assembly of claim 9, wherein the toe barrier is substantially planar and is adapted to lie relatively flat on a floor of a loading platform in its open position and is adapted to extend upwards at an angle with respect to the floor of the loading platform in its lower first-side barrier position.

22. The barrier assembly of claim 21, wherein the angle is greater than 45 degrees.

23. A method for protecting an edge of an elevated mezzanine, having an elevated loading-side edge and a pick-side, comprising the steps of:

providing a pick-side barrier that reciprocates between an open position and a barrier position in a pick-side opening, and a loading-side barrier that reciprocates between an open position and a barrier position in a loading-side opening, the two barriers being operatively coupled such that when the pick-side barrier is in its open position the loading-side barrier is in its barrier position, and when the pick-side barrier is in its barrier position, the loading-side barrier is in its open position;

repositioning the loading-side barrier to its barrier position and the pick-side barrier to its open position; and, substantially simultaneous to the repositioning step, automatically erecting a toe barrier along a floor approximate a loading-side edge.

24. The method of claim 23, further comprising the steps of:

returning the loading-side barrier to its open position and the pick-side barrier to its barrier position; and, substantially simultaneous to the returning step, automatically lowering the toe barrier along the floor approximate the loading-side edge.

25. The method of claim 23, further comprising the step of, subsequent to the repositioning step, automatically locking the loading-side barrier in its barrier position and the pick-side barrier in its open position.

26. The method of claim 25, further comprising the steps of:

after the automatic locking step, manually unlocking the loading-side and pick-side barriers from their respective positions; and, after the manual unlocking step, returning the loading-side barrier to its open position and the pick-side barrier to its barrier position.

27. A method for protecting an edge of an elevated mezzanine, having an elevated loading-side edge and a pick-side, comprising the steps of:

providing a pick-side barrier along at least one rail reciprocating between an open position and a barrier position in a pick-side opening, and a loading-side barrier reciprocating between an open position and a barrier position in a loading-side opening, the two barriers being operatively coupled such that when the pick-side barrier is in its open position the loading-side barrier is in its barrier position, and when the pick-side barrier is in its barrier position, the loading-side barrier is in its open position;

repositioning the loading-side barrier to its closed position and the pick-side barrier to its open position; and, locking the loading-side barrier in its closed position and the pick-side barrier in its open position during or after the repositioning step.

28. The method of claim 27, further comprising the steps of:

unlocking the loading-side barrier from its closed position and the pick-side barrier in its open position after the locking step; and, returning the loading-side barrier to its open position and the pick-side barrier to its closed position after the unlocking step.

29. The method of claim 28, wherein:

the locking step is automatic; and, the unlocking step is manual and performed approximate the pick-side barrier.

30. The method of claim 29, wherein the unlocking step includes the step of:

stepping on a pedal approximate the pick-side barrier to perform the unlocking step.

31. The method of claim 29, wherein the unlocking step includes the step of:

pulling on a release cord approximate the pick-side barrier to perform the unlocking step.

32. The method of claim 29, wherein the unlocking step includes the step of:

pressing a button approximate the pick-side barrier to perform the unlocking step.

33. A barrier assembly for protecting an edge of a loading platform comprising:

a gate reciprocating between a barrier position adapted to be approximate an edge of a loading platform and an open position adapted to be away from the edge of the loading platform;

a toe barrier adapted to be mounted approximate the edge of the loading platform and operatively coupled to the gate to reciprocate between a barrier position, which is adapted to provide a vertical barrier along a floor of the loading platform approximate the edge of the loading platform, and an open positional, which substantially removes the vertical barrier, and, a means for operatively coupling the toe barrier with the gate to reciprocate the toe barrier to its barrier position when the gate is in its barrier position and to reciprocate the toe barrier to its open position when the gate is in its open position.

34. A barrier assembly for protecting a loading platform, the loading platform having a loading edge and a personnel entrance distal from and substantially parallel to the loading edge, the barrier assembly comprising:

a pair of parallel guide rails, each having a first substantially vertical portion, a second substantially vertical portion opposite the first substantially vertical portion and an elevated substantially horizontal portion operatively interconnecting the first and second substantially vertical portions;

a first gate segment having at least one pair of rollers positioned on opposite lateral sides thereof, each roller being received by a respective one of the guide rails so that the first gate segment is guided by the pair of guide rails, the first gate segment being guided by the pair of guide rails from an upper first-side burner position in which the first gate segment is positioned within the first substantially vertical portions of the pair of guide rails to a first-side open position in which the first gate segment is positioned at least partially within the substantially horizontal portions of the pair of guide rails; and, a toe barrier spanning at least a portion of the distance between lower ends of the first substantially vertical portions of the pair of guide rails; and, a means for positioning the toe barrier at a lower first-side barrier position, below the upper first-side barrier position, while the first gate segment is approximate its upper first-side barrier position, and to return to the toe barrier to an open position while the first gate segment is approximate its first-side open position.

35. The barrier assembly of claim 34, further comprising a means for locking the first gate segment in its upper barrier position.

36. A barrier assembly for protecting a loading platform, the loading platform having a loading edge and a personnel entrance distal from and substantially parallel to the loading edge, the barrier assembly comprising:

a means for guiding gate segments having a first substantially vertical portion, a second substantially vertical portion opposite the first substantially vertical portion and an elevated substantially horizontal portion operatively between the first and second substantially vertical portions;

a first gate segment having means for mounting the guiding means to the first gate segment so that the first gate segment is guided by the guiding means from an upper first-side barrier position in which the first gate segment is positioned within the first substantially vertical portions of the guiding means to a first-side open position in which the first gate segment is positioned at least partially within the substantially horizontal portions of the guiding means;

a toe barrier spanning at least a portion of the distance between lower ends of the first substantially vertical portions of the guiding means; and, a means for positioning the toe barrier at a lower first-side barrier position, below the upper first-side barrier position, while the first gate segment is approximate its upper first-side barrier position, and to return to the toe barrier to an open position while the first gate segment is approximate its first-side open position.

* * * * *

UNITED STATES PATENT AND TRADEMARK OFFICE

CERTIFICATE OF CORRECTION

PATENT NO. : 6,837,296 B2
DATED : January 4, 2005
INVENTOR(S) : Kimener

It is certified that error appears in the above-identified patent and that said Letters Patent is hereby corrected as shown below:

Column 18,
Line 35, between the words "operative" and "drop" insert the word -- to -- to read "operative to drop".

Signed and Sealed this

Twelfth Day of July, 2005

JON W. DUDAS
*Director of the United States Patent and Trademark Office*